US008858280B1

(12) United States Patent
Wiegele et al.

(10) Patent No.: US 8,858,280 B1
(45) Date of Patent: Oct. 14, 2014

(54) MARINE ENGINE RIGGING SYSTEM

(75) Inventors: Dale A. Wiegele, Kenosha, WI (US); Jeff T. Turner, Beach Park, IL (US); John Charles Scott, Lake Villa, IL (US); Mark C. Noble, Pleasant Prairie, WI (US); Patrick C. Tetzlaff, Caledonia, WI (US)

(73) Assignee: BRP US Inc., Sturtevant, WI (US)

( * ) Notice: Subject to any disclaimer, the term of this patent is extended or adjusted under 35 U.S.C. 154(b) by 350 days.

(21) Appl. No.: 13/285,369

(22) Filed: Oct. 31, 2011

Related U.S. Application Data

(60) Provisional application No. 61/408,207, filed on Oct. 29, 2010.

(51) Int. Cl.
*B63H 20/00* (2006.01)
*B63H 20/32* (2006.01)
*B63H 21/36* (2006.01)

(52) U.S. Cl.
USPC ..... 440/76; 440/77; 123/195 C; 123/195 E; 123/195 P

(58) Field of Classification Search
CPC ..... B63H 20/00; B63H 20/001; B63H 20/32; B63H 21/22; B63H 21/36; F02B 61/045; F02D 2400/21; H02G 3/08; H02G 3/22
USPC ..... 440/76–78; 123/143 C, 195 A, 195 C, 123/195 E, 195 P
See application file for complete search history.

(56) References Cited

U.S. PATENT DOCUMENTS

| | | | |
|---|---|---|---|
| 3,162,412 | A | 12/1964 | McEntire |
| 3,564,113 | A | 2/1971 | Kindler |
| 4,348,194 | A | 9/1982 | Walsh |
| 4,416,475 | A | 11/1983 | Stacey |
| 4,517,408 | A | 5/1985 | Pegram |
| 4,623,313 | A | 11/1986 | Ferguson |
| 4,652,072 | A | 3/1987 | Arasi, Jr. |
| 4,657,513 | A | 4/1987 | Baker |
| 4,708,673 | A | 11/1987 | Dunham et al. |

(Continued)

FOREIGN PATENT DOCUMENTS

| | | |
|---|---|---|
| GB | 2161772 A | 1/1986 |
| JP | 6220794 | 1/1987 |

(Continued)

OTHER PUBLICATIONS

English Abstract of JP6220794, Published Jan. 29, 1987; Retrieved from http://worldwide.espacenet.com/ on May 27, 2013.

*Primary Examiner* — Ajay Vasudeva
(74) *Attorney, Agent, or Firm* — BCF LLP

(57) ABSTRACT

An outboard engine has a cowling defining an engine compartment, an internal combustion engine disposed at least in part in the engine compartment, a driveshaft operatively connected to the internal combustion engine, and one of a propeller and an impeller operatively connected to the driveshaft. The one of the propeller and the impeller rotates about an axis that is angled relative to the driveshaft. A device is disposed inside the engine compartment. A box is disposed outside the engine compartment and is operatively connected to the engine compartment. A line has a portion disposed inside the box and an end operatively connected to the device. An outboard engine having a box disposed outside the engine compartment and operatively connected to the bracket is also disclosed. A watercraft having the outboard engine is also disclosed.

19 Claims, 30 Drawing Sheets

(56) References Cited

U.S. PATENT DOCUMENTS

| | | | | |
|---|---|---|---|---|
| 4,753,619 | A | 6/1988 | Sullivan | |
| 4,781,634 | A | 11/1988 | Harris et al. | |
| 4,864,080 | A | 9/1989 | Fochler et al. | |
| 4,932,875 | A | 6/1990 | Ogawa et al. | |
| 4,933,809 | A * | 6/1990 | Boede et al. | 361/736 |
| 4,969,847 | A | 11/1990 | Curtis et al. | |
| 5,052,353 | A | 10/1991 | Dunham et al. | |
| 5,078,629 | A | 1/1992 | Mondek | |
| 5,080,618 | A | 1/1992 | Dunham et al. | |
| 5,129,847 | A | 7/1992 | Mondek | |
| 5,176,551 | A | 1/1993 | Blanchard et al. | |
| 5,207,186 | A * | 5/1993 | Okita | 123/41.31 |
| 5,637,021 | A | 6/1997 | Watanabe | |
| 5,836,212 | A | 11/1998 | Batess | |
| 5,967,865 | A | 10/1999 | Nakamura et al. | |
| 6,048,236 | A | 4/2000 | Natsume | |
| 6,183,322 | B1 | 2/2001 | Takahashi | |
| 6,257,940 | B1 | 7/2001 | Dunham et al. | |
| 6,283,807 | B1 | 9/2001 | Kokubo et al. | |
| 6,364,724 | B1 | 4/2002 | Nozawa et al. | |
| 6,902,450 | B2 * | 6/2005 | Ohtsuki et al. | 440/63 |
| 6,915,771 | B2 | 7/2005 | Watanabe | |
| 6,923,695 | B2 | 8/2005 | Ide et al. | |
| 6,960,108 | B1 | 11/2005 | Jaszewski et al. | |
| 6,962,513 | B2 * | 11/2005 | Kimata et al. | 440/2 |
| 6,964,591 | B2 * | 11/2005 | Takada et al. | 440/86 |
| 7,104,856 | B1 | 9/2006 | Krupp et al. | |
| 7,500,891 | B2 | 3/2009 | Yazaki | |
| 7,510,451 | B2 | 3/2009 | Inaba | |
| 7,621,791 | B2 | 11/2009 | Yazaki et al. | |
| 7,704,109 | B2 | 4/2010 | Arai et al. | |
| 8,133,085 | B2 * | 3/2012 | Hasegawa et al. | 440/77 |
| 8,210,886 | B1 | 7/2012 | Pelini | |

FOREIGN PATENT DOCUMENTS

| | | | | |
|---|---|---|---|---|
| JP | 62128899 | A * | 6/1987 | B63H 21/26 |
| JP | 06211191 | A * | 8/1994 | B63H 21/26 |
| JP | 2000006888 | A * | 1/2000 | B63H 20/00 |
| JP | 2006151010 | A * | 6/2006 | |

* cited by examiner

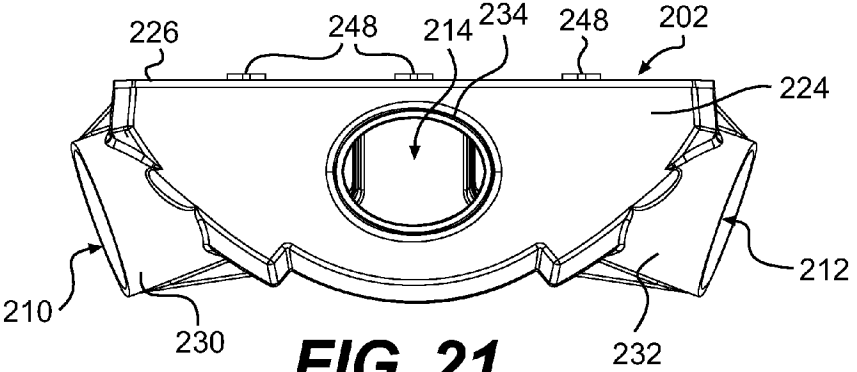
FIG. 21
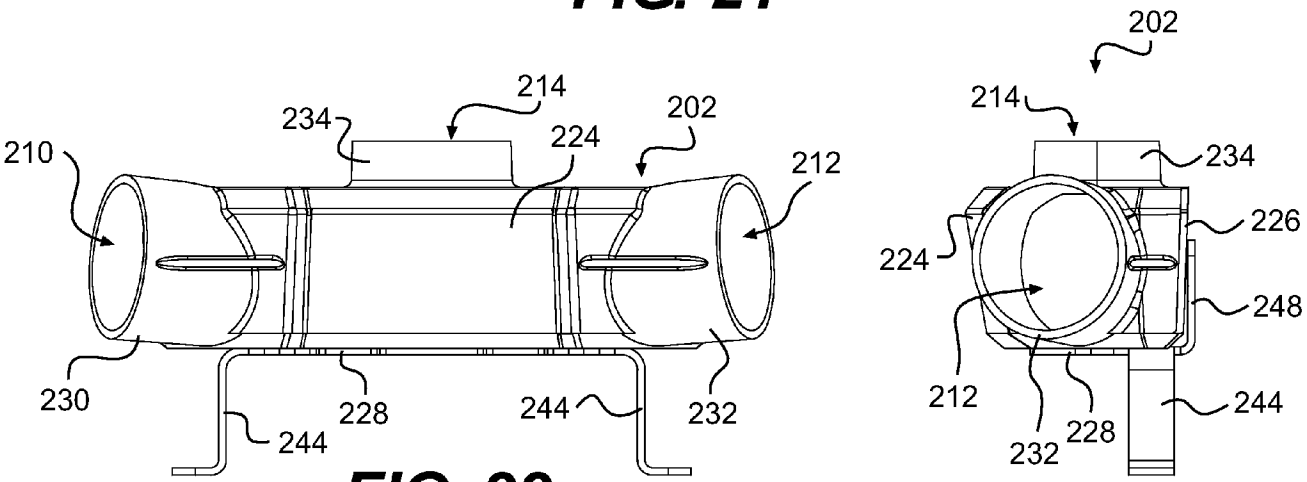
FIG. 22
FIG. 23

MARINE ENGINE RIGGING SYSTEM

CROSS-REFERENCE

The present application claims priority to U.S. Provisional Patent Application No. 61/408,207, filed Oct. 29, 2011, the entirety of which is incorporated herein by reference.

FIELD OF THE INVENTION

The present invention relates to a system for installing a marine engine on a watercraft.

BACKGROUND

To install a marine outboard engine, or other marine engine, on a watercraft, various lines need to be connected from the watercraft to the outboard engine. This is often referred to as rigging. These lines include, for example, a fuel line connected between the watercraft's fuel pump to the outboard engine's injectors, an electrical wire or cable connected between a battery in the watercraft and an electrical device of the outboard engine, and one or more data transmission cables connected between one or more sensors in the watercraft and an electronic control unit of the outboard engine and/or between one or more gauges on the watercraft and a data transmission device associated with the outboard engine.

In order to connect these lines, the person installing the outboard engine on the watercraft needs to route all of these lines inside the cowling of the outboard engine to the corresponding devices. This can prove to be time consuming, difficult, and can lead to lines being installed improperly. For example, a line could be unintentionally mounted near a part of the engine of the outboard engine which gets hot during operation, possibly resulting in the melting of the line and therefore failure of the device to which it is connected. This also makes maintenance of the outboard engine difficult where the maintenance requires that the outboard engine be removed from the watercraft.

Therefore, there is a need for a system that facilitates the installation of an outboard engine to a watercraft.

SUMMARY

It is an object of the present invention to ameliorate at least some of the inconveniences present in the prior art.

A box is provided on a watercraft having an outboard engine. Instead of connecting lines, such as a fuel hose and an electrical wire, from devices in the watercraft directly to corresponding devices inside the cowling of the outboard engine as in the prior art, the lines are each replaced by two lines, one coming from the device in the watercraft and one coming from the device inside the cowling, and each set of two lines are connected to each other inside the box. In one implementation, the lines coming from the devices in the cowling are installed by the manufacturer of the outboard engine and have their ends prearranged inside the box. Since the box is located in an easily accessible location, the connection of the lines from the devices in the watercraft to their corresponding lines from the devices in the cowling when mounting the outboard engine to the watercraft or when doing maintenance on the outboard engine is facilitated. The box can also be used to facilitate the routing of one or more lines from one or more devices in the watercraft to one or more corresponding devices in the cowling by passing the one or more lines through the box.

An outboard engine having such a box is also provided.

A watercraft having an inboard engine and a similar box is also provided.

In one aspect, an outboard engine has a cowling defining an engine compartment, an internal combustion engine disposed at least in part in the engine compartment, a driveshaft operatively connected to the internal combustion engine, and one of a propeller and an impeller operatively connected to the driveshaft. The one of the propeller and the impeller rotates about an axis that is angled relative to the driveshaft. A device is disposed inside the engine compartment. A box is disposed outside the engine compartment and is operatively connected to the engine compartment. A line has a portion disposed inside the box and an end operatively connected to the device.

In an additional aspect, the end of the line that is operatively connected to the device is a first end. The line has a second end disposed inside the box. The second end is adapted to connect inside the box to a first end of an other line. The other line has a second end disposed outside of the box and adapted to operatively connect to an other device disposed externally of the cowling.

In a further aspect, the end of the line operatively connected to the device is a first end. The line extends from the first end, passes through the box and extends to a second end disposed outside the box. The second end is adapted to operatively connect to an other device disposed externally of the cowling.

In an additional aspect, an operative connection between the end of the line and the device is located inside the engine compartment.

In a further aspect, a connector passese through a wall of the engine compartment. The connector has a first portion disposed inside the box and a second portion disposed inside the engine compartment. An other line is disposed inside the engine compartment. The other line is operatively connected between the first device and the second portion of the connector. The end of the line connects to the first portion of the connector.

In an additional aspect, the box is defined at least in part by the cowling.

In a further aspect, the box is disposed forwardly of the engine compartment.

In an additional aspect, the cowling has a selectively removable panel defining a front wall of the box. An interior of the box is accessible by removing the panel.

In another aspect, a watercraft has a hull and an outboard engine operatively connected to the hull. The outboard engine has a bracket connecting the outboard engine to the hull. The bracket is pivotable about a first horizontal axis to tilt and trim the outboard engine. The outboard engine is pivotably connected to the bracket about a second axis generally perpendicular to the first axis. The outboard engine is steerable by pivoting the outboard engine about the second axis. The outboard engine also has a cowling defining an engine compartment, an internal combustion engine disposed at least in part in the engine compartment, a driveshaft operatively connected to the internal combustion engine, and one of a propeller and an impeller operatively connected to the driveshaft. The one of the propeller and the impeller rotates about an axis that is angled relative to the driveshaft. A first device is disposed inside the cowling. A box is disposed outside the engine compartment and is operatively connected to the bracket. A second device is disposed externally of the cowling. A line operatively connects the first device and the second device. The line has a portion disposed inside the box and an end operatively connected to the first device.

In a further aspect, the end of the line that is operatively connected to the first device is a first end. The line has a second end disposed inside the box. The second end is operatively connected inside the box to a first end of an other line. The other line has a second end disposed outside of the box and operatively connected to the second device.

In an additional aspect, the end of the line that is operatively connected to the first device is a first end. The line extends from the first end, passes through the box and extends to a second end disposed outside the box. The second end is operatively connected to the second device.

In a further aspect, the box is a first box and the line is a first line. The watercraft also has a second box disposed outside the engine compartment and operatively connected to the engine compartment. The first end of the first line is disposed inside the second box. A second line has a first end operatively connected to the first device and a second end operatively connected to the first end of the first line inside the second box.

In an additional aspect, the outboard engine is a first outboard engine and the line is a first line. The watercraft also has a second outboard engine operatively connected to the hull. The second outboard engine has a bracket connecting the second outboard engine to the hull. The bracket is pivotable about a first horizontal axis to tilt and trim the second outboard engine. The second outboard engine is pivotably connected to the bracket about a second axis generally perpendicular to the first axis. The second outboard engine is steerable by pivoting the second outboard engine about the second axis. The second outboard engine also has a cowling defining an engine compartment, an internal combustion engine disposed at least in part in the engine compartment, a driveshaft operatively connected to the internal combustion engine, and one of a propeller and an impeller operatively connected to the driveshaft, the one of the propeller and the impeller rotating about an axis being angled relative to the driveshaft. A third device is disposed inside the cowling of the second outboard engine. A box is disposed outside the engine compartment of the second outboard engine and being operatively connected to the bracket of the second outboard engine. A fourth device is disposed externally of the cowling of the second outboard engine. A second line operatively connects the third device and the fourth device and passes through the box of the first outboard engine and the box of the second outboard engine.

In a further aspect, the outboard engine is a first outboard engine. The watercraft also has a second outboard engine operatively connected to the hull. The second outboard engine has a bracket connecting the second outboard engine to the hull, the bracket being pivotable about a first horizontal axis to tilt and trim the outboard engine, the outboard engine being pivotably connected to the bracket about a second axis generally perpendicular to the first axis. The second outboard engine is steerable by pivoting the second outboard engine about the second axis. The second outboard engine also has a cowling defining an engine compartment, an internal combustion engine disposed at least in part in the engine compartment, a driveshaft operatively connected to the internal combustion engine, and one of a propeller and an impeller operatively connected to the driveshaft, the one of the propeller and the impeller rotating about an axis being angled relative to the driveshaft. A box is disposed outside the engine compartment of the second outboard engine and is operatively connected to the bracket of the second outboard engine. The line passes through the box of the second outboard engine.

In another aspect, an outboard engine has a bracket adapted to connect the outboard engine to a hull of a watercraft. The bracket is pivotable about a first horizontal axis to tilt and trim the outboard engine. The outboard engine is pivotably connected to the bracket about a second axis perpendicular to the first axis. The outboard engine is steerable by pivoting the outboard engine about the second axis. The outboard engine also has a cowling defining an engine compartment, an internal combustion engine disposed at least in part in the engine compartment, a driveshaft operatively connected to the internal combustion engine, and one of a propeller and an impeller operatively connected to the driveshaft. The one of the propeller and the impeller rotates about an axis that is angled relative to the driveshaft. A device is disposed inside the cowling. A box is disposed outside the engine compartment and is operatively connected to the bracket. A line has a portion disposed inside the box and an end operatively connected to the device.

In an additional aspect, the end of the line that is operatively connected to the device is a first end. The line has a second end disposed inside the box. The second end is adapted to connect inside the box to a first end of an other line. The other line has a second end disposed outside of the box and adapted to operatively connect to an other device disposed externally of the cowling.

In a further aspect, the end of the line that is operatively connected to the device is a first end. The line extends from the first end, passes through the box and extends to a second end disposed outside the box. The second end is adapted to operatively connect to an other device disposed externally of the cowling.

In an additional aspect, the line passes through the box via a first opening in a lateral side of the box and a second opening in a top of the box.

In a further aspect, an operative connection between the end of the line and the device is located inside the engine compartment.

In an additional aspect, the second axis is disposed between the box and the driveshaft relative to a longitudinal direction of the outboard engine.

In a further aspect, the box pivots about the first horizontal axis when the outboard engine is tilted.

In an additional aspect, the device is one of a fuel injector, an oil supply device, an electrical device, and a data transmission and/or receiving device. The line is a corresponding one of a fuel hose, an oil hose, an electrical wire, and a data transmission cable.

For purposes of this application, the term related to spatial orientation such as forward, rearward, left, right, vertical, and horizontal are as they would normally be understood by a driver of the watercraft sitting thereon in a normal driving position. Also for purposes of this application, the term "line" refers to an element used to transport one of a fluid, electrical power, and a data signal between two other elements. It is contemplated that a line could transport both electrical power and a data signal. Examples of lines include, but are not limited to, a hose, a pipe, an electrical wire, an electrical cable, and a data transmission cable. It is contemplated that a cable could be made of multiple wires.

Embodiments of the present invention each have at least one of the above-mentioned aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where:

FIG. 21 is a top plan view of the box of FIG. 20;

FIG. 22 is a front elevation view of the box of FIG. 20;

FIG. 23 is a left side elevation view of the box of FIG. 20;

DETAILED DESCRIPTION

Figure 1:
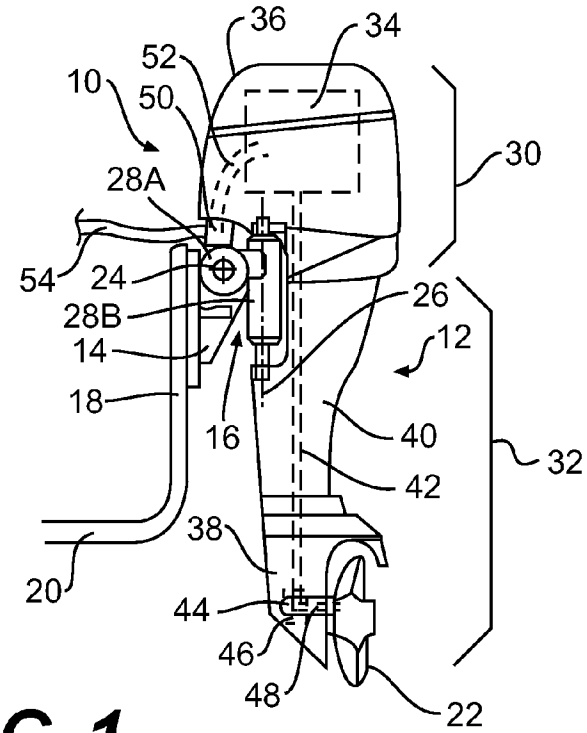
FIG. 1 is a left side elevation view of an outboard engine according to an embodiment installed on a watercraft.

With reference to FIG. 1, the marine outboard engine 10, shown in the upright position, includes a drive unit 12, a stern bracket 14 and an integrated tilt/trim/steering subsystem 16. The stern bracket 14 and the integrated tilt/trim/steering subsystem 16 support the drive unit 12 on a transom 18 of a hull 20 of an associated watercraft such that a propeller 22 is in a submerged position with the watercraft resting relative to a surface of a body of water. The drive unit 12 can be tilted up or down relative to the hull 20 by the integrated tilt/trim/steering subsystem 16 about a tilt axis 24 extending generally horizontally. The drive unit 12 can also be steered left or right relative to the hull 20 by the integrated tilt/trim/steering subsystem 16 about a steering axis 26 extending generally perpendicularly to the tilt axis 24. When the drive unit 16 is in the upright position as shown in FIG. 1, the steering axis 26 extends generally vertically. The integrated tilt/trim/steering subsystem 16 uses hydraulic rotary actuators 28A and 28B to tilt, trim and steer the drive unit 12 as described in greater detail below.

The drive unit 12 includes an upper portion 30 and a lower portion 32. The upper portion 30 includes an engine 34 surrounded and protected by a cowling 36. The engine 34 housed within the cowling 36 is an internal combustion engine having cylinders extending horizontally, such as a two-stroke or four-stroke engine. The lower portion 32 includes the gear case assembly 38, which includes the propeller 22, and the skeg portion 40, which extends from the upper portion 30 to the gear case assembly 38.

The engine 34 is coupled to a driveshaft 42. When the drive unit 12 is in the upright position as shown in FIG. 1, the driveshaft 42 is oriented vertically. It is contemplated that the driveshaft 42 could be oriented differently relative to the engine 34. The driveshaft 42 is coupled to a drive mechanism 44, which includes a transmission 46 and the propeller 22 mounted on a propeller shaft 48. In FIG. 1, the propeller shaft 48 is perpendicular to the driveshaft 42, however it is contemplated that it could be at other angles. The driveshaft 42 as well as the drive mechanism 44 are housed within the gear case assembly 38, and transfer the power of the engine 34 to the propeller 22 mounted on the rear side of the gear case assembly 38 of the drive unit 12. It is contemplated that the propulsion system of the outboard engine 10 could alternatively include a jet propulsion device, turbine or other known propelling device. It is further contemplated that the bladed rotor could alternatively be an impeller. Other known components of an engine assembly are included within the cowling 36, such as a starter motor, an alternator and the exhaust system. As it is believed that these components would be readily recognized by one of ordinary skill in the art, further explanation and description of these components will not be provided herein.

The tilt/trim/steering subsystem 16 includes a tilt/trim hydraulic rotary actuator 28A oriented horizontally relative to the hull 20 and a steering hydraulic rotary actuator 28B which is perpendicular to the tilt/trim actuator 28A and oriented vertically when the drive unit 12 of the marine outboard engine 10 is in the upright position as illustrated in FIG. 1. Additional details regarding the tilt/trim/steering subsystem 16 can be found in U.S. Pat. No. 7,736,206 B1, issued Jun. 15, 2010, the entirety of which is incorporated herein by reference. It is contemplated that tilt, trim and steering could be achieved using other types of systems/subsystems. For example, the actuators 28A and 28B could be replaced by linear hydraulic actuators.

To facilitate the installation of the outboard engine 10 on the watercraft, the outboard engine 10 is provided with a box 50. The box 50 is connected on top of the rotary actuator 28A so as to be connected to the stern bracket 14. It is contemplated that the box 50 could be connected directly to the stern bracket 14. As a result, the box 50 pivots about the tilt axis 24 when the outboard engine 10 is tilted, but does not pivot about the steering axis 26 when the outboard engine 10 is steered. It is contemplated that the box could be mounted elsewhere on the outboard engine 10. For example, the box 50 could be connected to an outside of the cowling 36 or could be formed at least in part by the cowling 36 itself.

As will be explained in greater detail below, devices located inside the cowling 36 which need to be connected to other devices disposed externally of the outboard engine 10, such as on the deck or hull of the watercraft, are provided with lines which extend inside the box 50. In one embodiment, these lines are installed in and routed to the box 50 by the manufacturer of the outboard engine 10 during manufacturing of the outboard engine 10. These lines pass through a tube 52 connected to the top of the box 50, which protects the lines and prevents a clutter of lines. Similarly, the corresponding devices disposed externally of the outboard engine 10 are also provided with lines that extend inside the box 50 where they are connected with their corresponding lines from the outboard engine 10. These lines pass through a tube 54 connected to the side of the box 50, which protects the lines and prevents a clutter of lines. It is contemplated that the tubes 52 and 54 could be omitted and that the lines could be bundled together by tie wraps for example. By centralizing the connections inside the box 50, the installation is simplified. Also, in the embodiment where the lines from the devices located inside the cowling 36 are installed by the manufacturer of the outboard engine 10, by eliminating the need for the person installing the outboard engine 10 to run these lines inside the cowling 36, the installation process is further simplified and the installation time reduced. It is contemplated that one or more lines could be connected between one or more devices located inside the cowling 36 to one or more devices located externally of the outboard engine 10 and simply pass through the box 50. In such an embodiment, the box 50 would reduce movement of the one or more lines when the outboard engine 10 is steered, tilted or trimmed.

Figure 2:
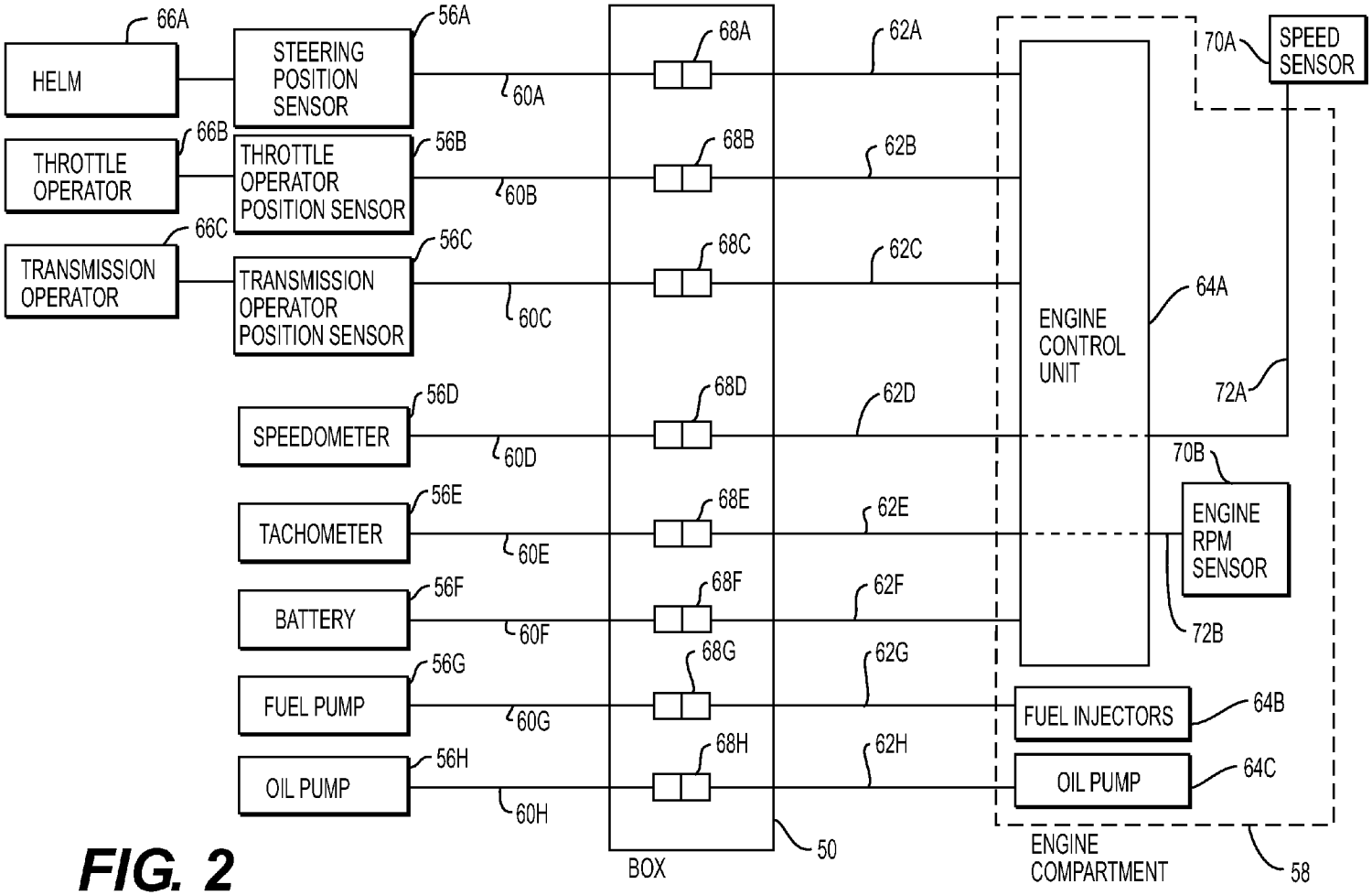
FIG. 2 is a schematic representation of an embodiment of a rigging system for the outboard engine and watercraft of FIG. 1.

FIG. 2 schematically illustrates an exemplary embodiment of a rigging system for the outboard engine 10 and watercraft of FIG. 1. As can be seen, a plurality of devices 56A to 56H disposed externally of an engine compartment 58 defined by the cowling 36 are connected by lines 60A to 60H and 62A to 62H respectively to a plurality of devices 64A to 64C disposed inside the engine compartment 58. As can be seen, the lines 60A to 60H connect to the lines 62A to 62H respectively inside the box 50. The engine compartment 58 corresponds to the volume defined by inner sides of the cowling 36 which surround the internal combustion engine 34. In the outboard engine 10, the portion of the cowling 36 disposed in the upper portion 30 defines the engine compartment 58. In other outboard engines, such as outboard engines 100 and 200 described below, the cowling 36 defines an engine compartment 58 and also defines other compartments or volumes around the engine compartment 58.

The rigging system of FIG. 2 will now be described in more detail.

A steering position sensor 56A senses the position of a helm 66A of a watercraft to which the outboard engine 10 is mounted. The steering position sensor 56A is disposed near the helm 66A. The steering position sensor 56A can be a digital or analog potentiometer, a rheostat, or any other type of sensor that can sense specific positions and/or changes in position. An electrical wire or cable 60A has one end operatively connected to the steering position sensor 56A and the other end disposed in the box 50 where it is operatively connected to an end of a corresponding electrical wire or cable 62A by connector(s) 68A. The connector(s) 68A can be any type of connector suitable for connecting the type of wires or cables used. The other end of the electrical wire or cable 62A is operatively connected to the engine control unit (ECU) 64A disposed inside the engine compartment 58. The ECU 64A receives data signals from the steering position sensor 56A and uses these data signals to control the integrated tilt/trim/steering subsystem 16, and more specifically the hydraulic rotary actuator 28B. Should the control of the engine 34 and/or other systems/subsystems of the outboard engine 10 take into account the steering position, the ECU 64A also uses the data signals from the steering position sensor 56A to control the engine 34 and/or these other systems/subsystems.

A throttle operator position sensor 56B senses the position of a throttle operator 66B of the watercraft to which the outboard engine 10 is mounted. The throttle operator position sensor 56B is disposed near the throttle operator 66B, which is disposed near the helm 66A to allow the driver to control the speed of the watercraft. The throttle operator position sensor 56B can be a digital or analog potentiometer, a rheostat, or any other type of sensor that can sense specific positions and/or changes in position. An electrical wire or cable 60B has one end operatively connected to the throttle operator position sensor 56B and the other end disposed in the box 50 where it is operatively connected to an end of a corresponding electrical wire or cable 62B by connector(s) 68B. The connector(s) 68B can be any type of connector suitable for connecting the type of wires or cables used. The other end of the electrical wire or cable 62B is operatively connected to the ECU 64A disposed inside the engine compartment 58. The ECU 64A receives data signals from the throttle operator position sensor 56B and uses these data signals to control the engine 34. Should the tilt/trim/steering subsystem 16 and/or other systems/subsystems of the outboard engine 10 take into account the throttle operator position, the ECU 64A also uses the data signals from the throttle operator position sensor 56B to control the tilt/trim/steering subsystem 16 and/or these other systems/subsystems.

A transmission operator position sensor 56C senses the position of a transmission operator 66C of the watercraft to which the outboard engine 10 is mounted. The transmission operator position sensor 56C is disposed near the transmission operator 66C, which is disposed near the helm 66A to allow the driver to select a position (forward, neutral, reverse) of the transmission 46. The transmission operator position sensor 56C can be a digital or analog potentiometer, a rheostat, or any other type of sensor that can sense specific positions and/or changes in position. An electrical wire or cable 60C has one end operatively connected to the transmission operator position sensor 56C and the other end disposed in the box 50 where it is operatively connected to an end of a corresponding electrical wire or cable 62C by connector(s) 68C. The connector(s) 68C can be any type of connector suitable for connecting the type of wires or cables used. The other end of the electrical wire or cable 62C is operatively connected to the ECU 64A disposed inside the engine compartment 58. The ECU 64A receives data signals from the transmission operator position sensor 56C and uses these data signals to control the transmission 46. Should other systems/subsystems of the outboard engine 10 take into account the transmission operator position, the ECU 64A also uses the data signals from the transmission operator position sensor 56C to control these other systems/subsystems.

A speedometer 56D displays the speed of the watercraft sensed by a speed sensor 70A in the manner described below. The speedometer 56D is disposed near the near the helm 66A so as to be easily viewed by the driver. The speed sensor 70A can be in the form of a paddle wheel type speed sensor or a pitot tube mounted to one of the hull 20 of the watercraft or the lower position 32 of the outboard engine 10. Alternatively, the speed sensor 70A could be a global positioning system (GPS) or any other type of speed sensor. An electrical wire or cable 60D has one end operatively connected to the speedometer 56D and the other end disposed in the box 50 where it is operatively connected to an end of a corresponding electrical wire or cable 62D by connector(s) 68D. The connector(s) 68D can be any type of connector suitable for connecting the type of wires or cables used. The other end of the electrical wire or cable 62D is operatively connected to the ECU 64A disposed inside the engine compartment 58. An electrical wire or cable 72A operatively connects the ECU 64A to the speed sensor 70A. It is contemplated that the speed sensor 70A could be connected directly to the speedometer 56D via electrical wires or cables 60D and 62D and be separately connected to the ECU 64A by the electrical wire or cable 72A. The ECU 64A receives data signals from the speed sensor 70A transmits data signals based on these data signals to the speedometer 56D such that the speedometer 56D displays the speed of the watercraft. Should other systems/subsystems of the outboard engine 10 take into account the speed of the watercraft, the ECU 64A also uses the data signals from the speed sensor 70A to control these other systems/subsystems.

A tachometer 56E displays the speed of rotation of a crankshaft of the engine 31 sensed by an engine speed sensor (engine RPM sensor) 70B in the manner described below. The tachometer 56E is disposed near the near the helm 66A so as to be easily viewed by the driver. The engine RPM sensor 70B is disposed near a flywheel of the engine 32 and allows the engine speed to be determined by generating a signal each time one or more specific points on the flywheel pass by the sensor 70B. Other types of engine RPM sensors could also be used. An electrical wire or cable 60E has one end operatively connected to the tachometer 56E and the other end disposed in the box 50 where it is operatively connected to an end of a corresponding electrical wire or cable 62E by connector(s) 68E. The connector(s) 68E can be any type of connector suitable for connecting the type of wires or cables used. The other end of the electrical wire or cable 62E is operatively connected to the ECU 64A disposed inside the engine compartment 58. An electrical wire or cable 72B operatively connects the ECU 64A to the engine RPM sensor 70B. It is contemplated that the engine RPM sensor 70B could be connected directly to the tachometer 56E via electrical wires or cables 60E and 62E and be separately connected to the ECU 64A by the electrical wire or cable 72B. The ECU 64A receives signals from the engine RPM sensor 70B transmits data signals based on these signals to the tachometer 56E such that the tachometer 56E displays the speed of the engine 32. The ECU 64A also uses the signals from the engine RPM sensor 70B to control the engine 32. Should other systems/subsystems of the outboard engine 10 take into account the speed of the engine 32, the ECU 64A also uses the signals from the engine RPM sensor 70B to control these other systems/subsystems.

It is contemplated that two or more of the electrical wires or cables 60A to 60E could be bundled in a common electrical cable, in which case the corresponding electrical wires or cables 62A to 62E would also be bundled in a common electrical cable.

It is also contemplated that two or more of the devices 56A to 56E could share a common electrical wire or cable, by using a controller-area network (CAN-bus), thus sending multiple data signals over the same wire or cable. In such a system, the wires or cables 62A to 62E that correspond to the wires or cables 60A to 60E that have been replaced by a common wire or cable are also replaced by a common wire or cable.

A battery 56F is disposed in the watercraft. An electrical wire or cable 60F has one end operatively connected to the battery 56F and the other end disposed in the box 50 where it is operatively connected to an end of a corresponding electrical wire or cable 62F by connector(s) 68F. The connector(s) 68F can be any type of connector suitable for connecting the type of wires or cables used. The other end of the electrical wire or cable 62F is operatively connected to the ECU 64A disposed inside the engine compartment 58. The ECU 64A receives electrical power from the battery 56F and transmits it to the various systems/subsystems that require it. It is contemplated that the battery 56F could also be operatively connected to the system/subsystems without passing via the ECU 64A, or to component relaying the electrical power to the batter 56F and/or to the systems/subsystems.

It is contemplated that the ECU 64A could be multiple ECUs adapted for specific tasks or the control of specific subsystems.

A fuel pump 56G is disposed inside a fuel tank (not shown) disposed in the hull 20 of the watercraft to which the outboard engine 10 is mounted. The fuel pump 56G pumps fuel to the fuel injectors 64B of the engine 32. A fuel hose 60G has one end operatively connected to the fuel pump 56G and the other end disposed in the box 50 where it is operatively connected to an end of a corresponding fuel hose 62G by connector(s) 68G. The connector(s) 68G can be any type of connector suitable for connecting the type of fuel hoses used. The other end of the fuel hose 62G is fluidly connected to the fuel injectors 64B disposed inside the engine compartment 58 on the engine 32. The fuel hose 62G fluidly communicates with the fuel injectors 64B via one or more of a secondary fuel pump, a secondary fuel tank, and a fuel rail.

An oil pump 56H is disposed inside an oil tank (not shown) disposed in the hull 20 of the watercraft to which the outboard engine 10 is mounted. The oil pump 56H pumps oil to the oil pump 64C disposed in the engine compartment 58. An oil hose 60H has one end operatively connected to the oil pump 56H and the other end disposed in the box 50 where it is operatively connected to an end of a corresponding oil hose 62H by connector(s) 68H. The connector(s) 68H can be any type of connector suitable for connecting the type of oil hoses used. The other end of the oil hose 62H is fluidly connected to the oil pump 64C. It is contemplated that the other end of the hose 62H could be connected to a secondary oil tank from which the oil pump 64C draws oil. The oil pump 64C pumps oil to the various elements of the engine 32 that require it.

The devices 56A to 56H described above are only one possible example of the devices that can be associated with an outboard engine. It is contemplated that fewer, more, and/or different devices could be used.

Figure 3:
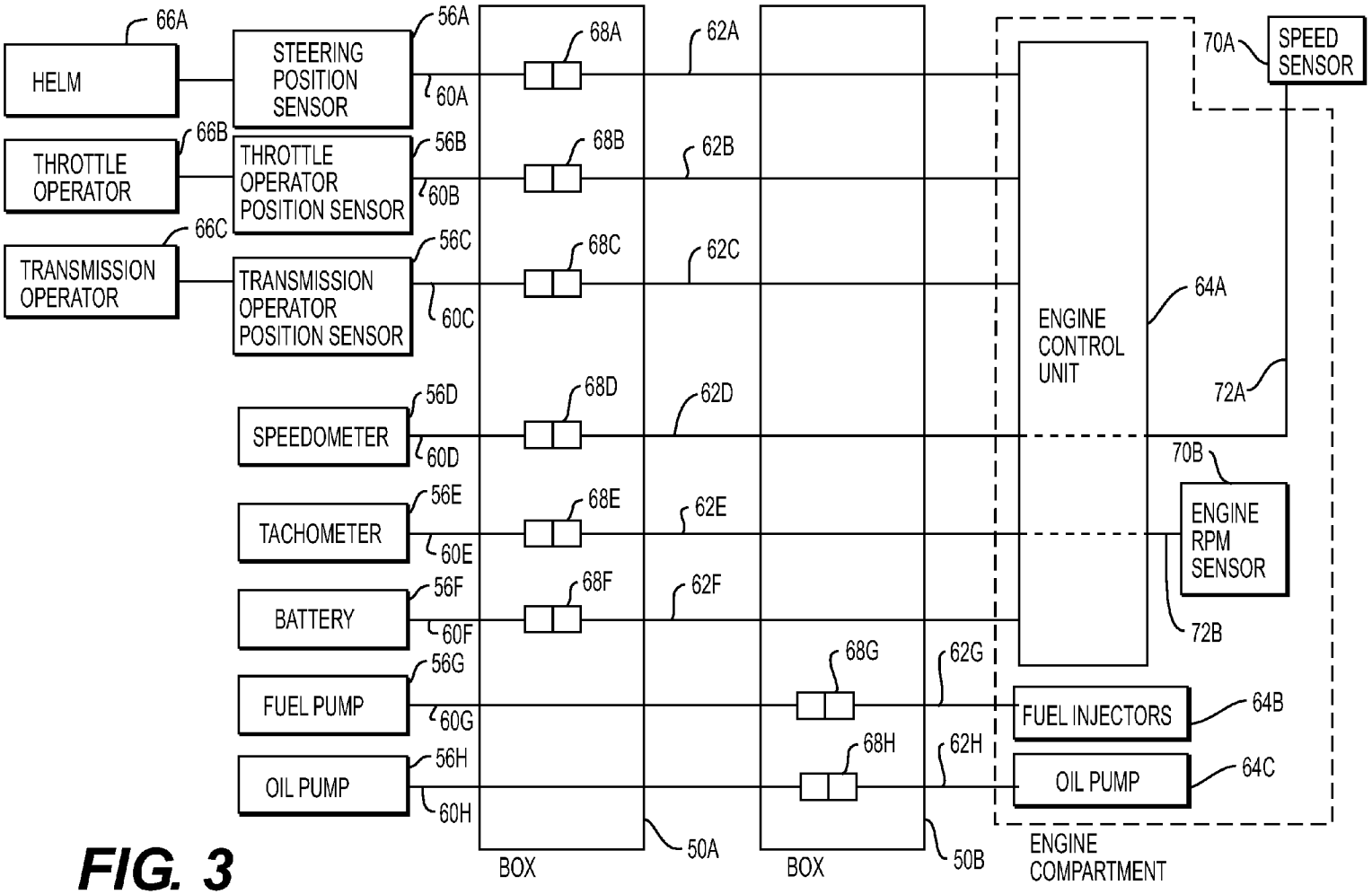
FIG. 3 is a schematic representation of another embodiment of a rigging system of the outboard engine and watercraft of FIG. 1.

FIG. 3 schematically illustrates an alternative exemplary embodiment of a rigging system for the outboard engine 10 and watercraft of FIG. 1. The rigging system of FIG. 3 has the same elements as the rigging system of FIG. 2, except that it has two boxes 50A, 50B instead of the single box 50 of the rigging system of FIG. 2. Therefore, for simplicity these elements will not be described again.

The box 50A is mounted to the stern bracket 14 in a manner similar to the box 50 described above. The box 50B is disposed outside the engine compartment and is connected to the outside or the inside of the cowling 36 or is formed by the cowling 36 at a position that can be easily accessed.

As can be seen in FIG. 3, the electrical wires or cables 60A to 60F are operatively connected to their corresponding electrical wires or cables 62A to 62F inside the box 50A. From the box 50A, the electrical wires or cables 62A to 62F pass through the box 50B prior to operatively connecting to the ECU 64A. It is contemplated that the electrical wires or cables 62A to 62F could not pass through the box 50B prior to operatively connecting to the ECU 64A. The hoses 60G and 60H are operatively connected to their corresponding hoses 62G and 62H inside the box 50B. The hoses 60G and 60H pass through the box 50A prior to entering the box 50B. It is contemplated that the hoses 60G and 60H could not pass through the box 50A prior to entering the box 50B. As can be seen, in this embodiment, the electrical connectors 68A to 60F are in the box 50A and the fluid connectors 68G and 68H are in the box 50B. It is contemplated that the electrical connectors 68A to 60F could be in the box 50B and the fluid connectors 68G and 68H could be in the box 50A. It is also contemplated that connectors 68A to 68H could be arranged differently between the two boxes 50A and 50B. It is also contemplated that more than two boxes could be used.

Turning now to FIGS. 4 to 7 another embodiment of an outboard engine (outboard engine 100) will be described. Features of the outboard engine 100 which are similar to those of the outboard engine 10 described above have been labeled with the same reference numerals as in the outboard engine 10. Also, for simplicity, these features will not be described again in detail.

Figure 4:
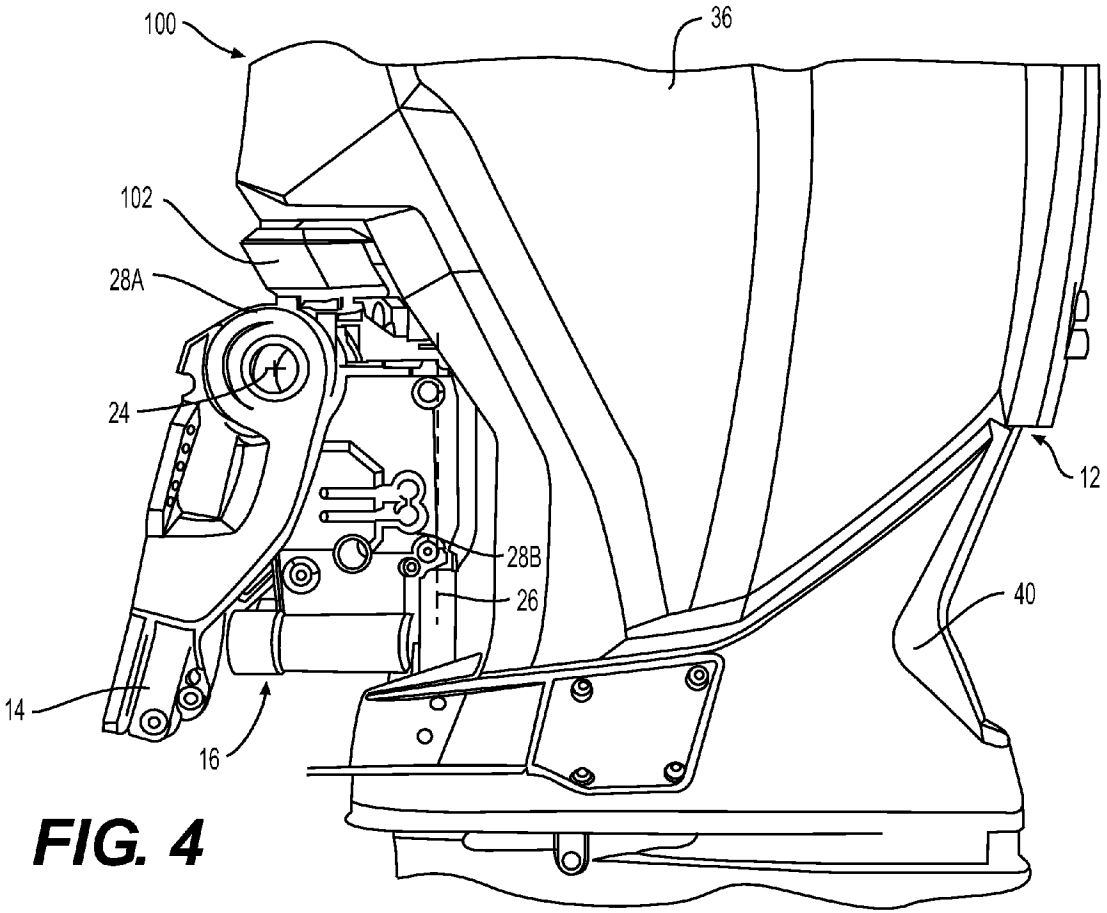
FIG. 4 is a close-up left side elevation view of an outboard engine according to another embodiment.

The outboard engine 100 is provided with a box 102 mounted on top of the integrated tilt/trim/steering subsystem 16 and is connected to the stern bracket 14 thereby. It is contemplated that the box 102 could be connected directly to the stern bracket 14. As best seen in FIG. 4, the box 102 is disposed forwardly of the steering axis 26. By positioning the box 102 in this manner, the box 102 pivots about the tilt axis 24 when the outboard engine 100 is trimmed or tilted. However, the box 102 does not turn about the steering axis 26 when the outboard engine 100 is steered.

Figure 7:
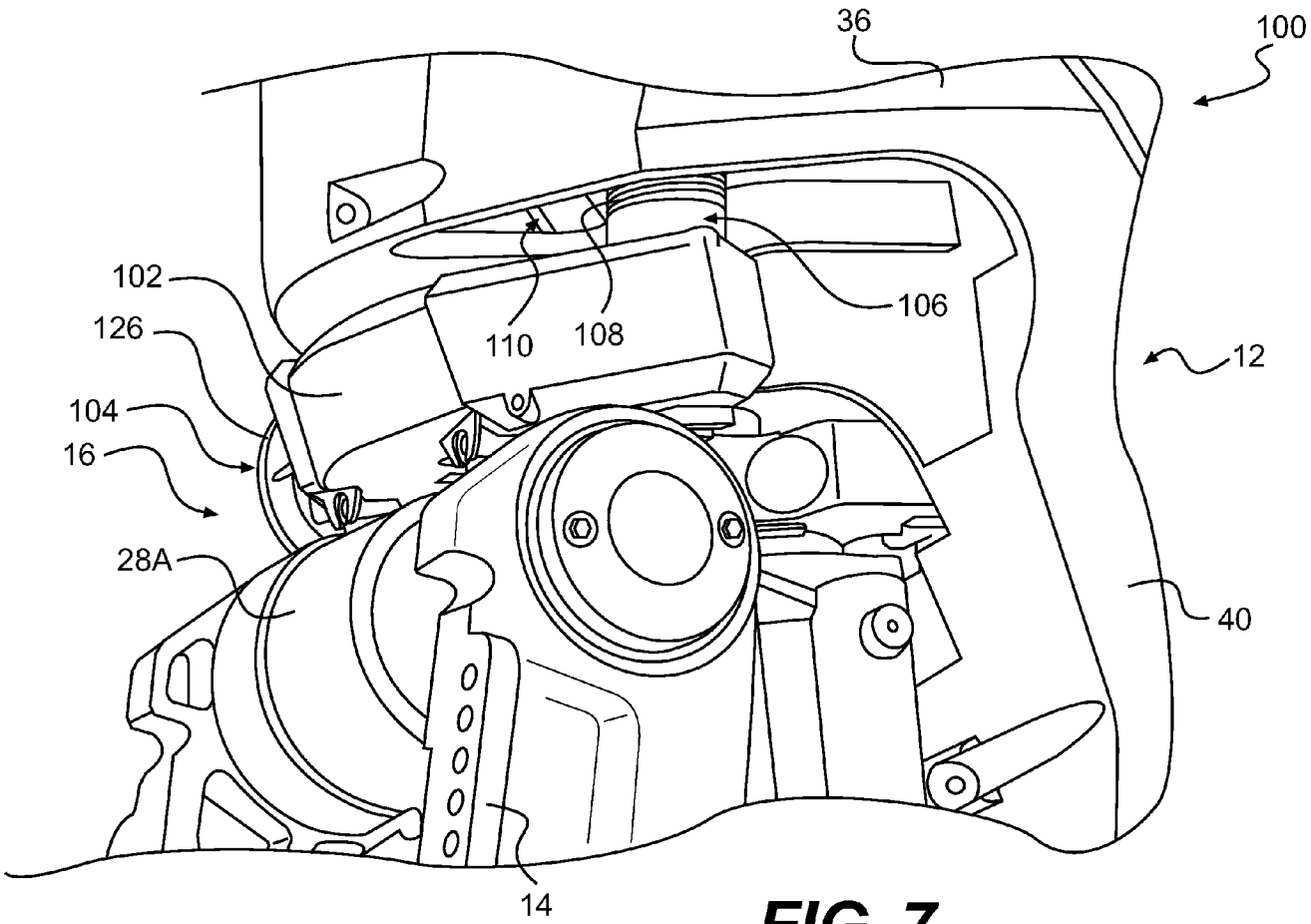
FIG. 7 is a close-up perspective view taken from a bottom, front, left side of the outboard engine of FIG. 4.
Figure 8:
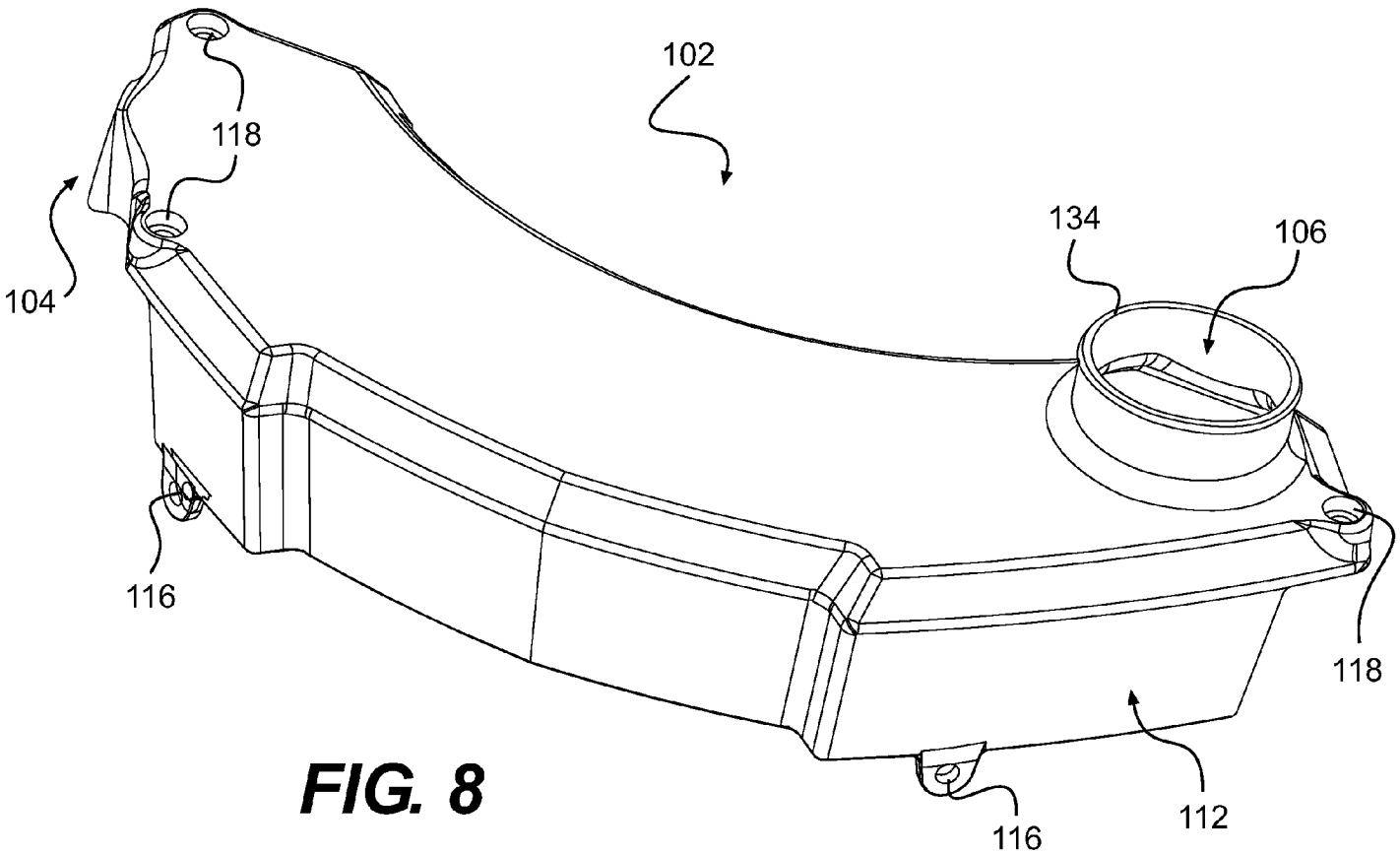
FIG. 8 is a perspective view taken from a front, left side of a box of the outboard engine of FIG. 4.

As best seen in FIG. 8, the box 102 has two openings 104 and 106. A tube (not shown) is connected to the opening 102 and extends to the watercraft to which the outboard engine 100 is connected. A plurality of lines, such as lines 60A to 60H described above in FIG. 2, is disposed inside the tube and extends between the box 102 and devices located in the watercraft, such as devices 56A to 56H described above in FIG. 2. It is contemplated that the tube could be omitted and that the lines could be bundled together by tie wraps for example. A tube 108 (see FIG. 7) is connected between the opening 106 and an opening (not shown) located near a top of a passage 110 (see FIG. 7) formed in the cowling 36. A plurality of lines, such as lines 62A to 62H described above in FIG. 2, is disposed inside the tube 108 and extends between the box 102 and devices located in the engine compartment defined by the cowling 36, such as devices 64A to 64C described above in FIG. 2. It is contemplated that the tube 108 could be omitted and that the lines could be bundled together by tie wraps for example. As in the embodiment of FIG. 2, the lines disposed in the tube connected to the opening 104 are connected at one end to devices in the watercraft. These lines are connected at the other end in the box 102 to corresponding ends of the lines disposed in the tube 108. The lines disposed in the tube 108 are connected at the other end to corresponding devices inside the engine compartment.

Figure 5:
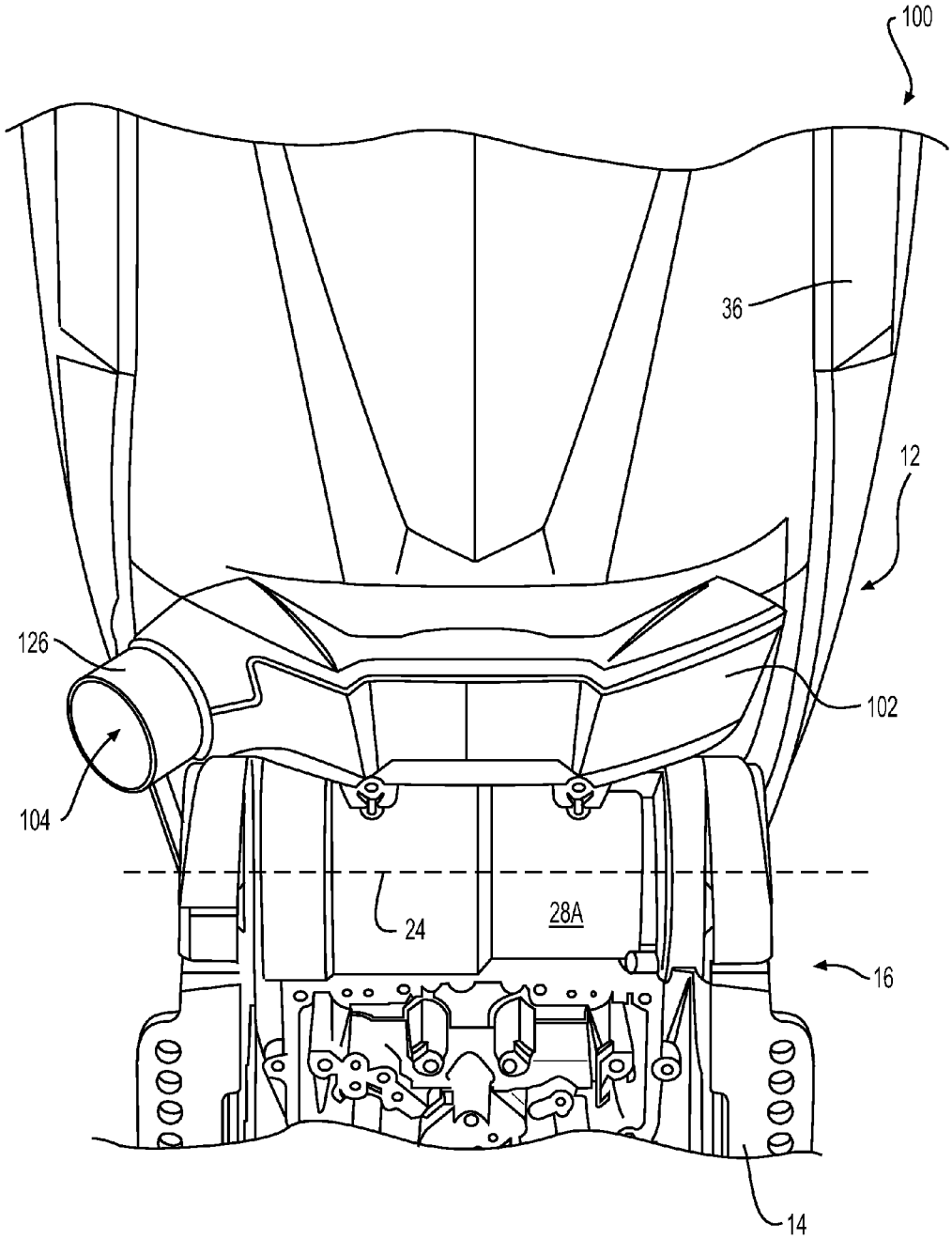
FIG. 5 is a close-up front elevation view of the outboard engine of FIG. 4.
Figure 6:
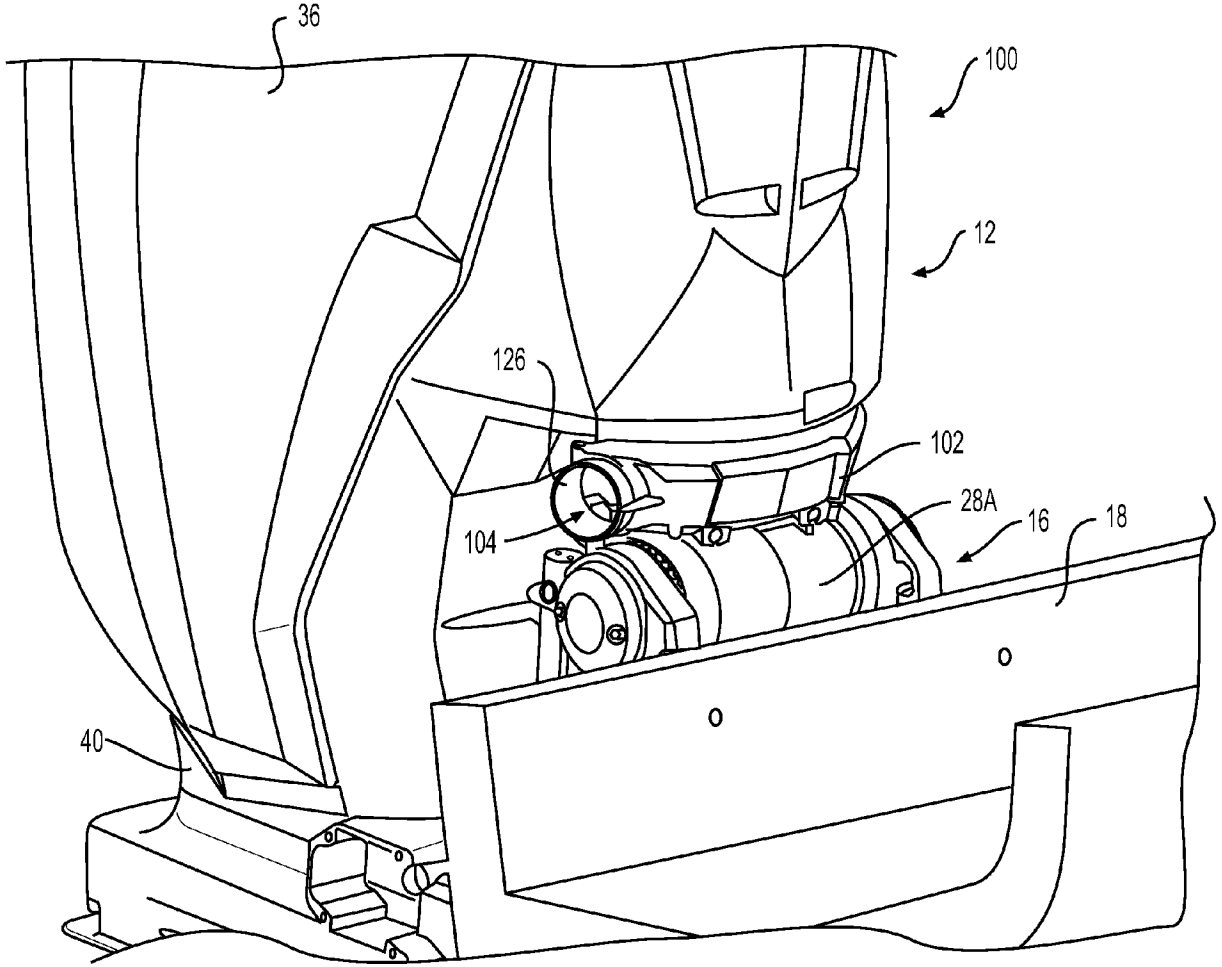
FIG. 6 is a perspective view taken from a front, right side of the outboard engine of FIG. 4.

As can be seen in FIGS. 5 and 6, the opening 104 is disposed on a right lateral side of the box 102. The opening 104 faces at an angle towards the front and right side of the outboard engine 100. Therefore, the tube connected to the opening 104 extends from the opening 104 towards the front and right side of the outboard engine 100 and is disposed relatively close to the tilt axis 24. By positioning the tube at this location and with this orientation, the tube, and therefore the lines disposed therein, does not move very much when the outboard engine 100 is trimmed or tilted about the tilt axis 24. It is contemplated that this movement of the tube could be further reduced by orienting the opening 104 such that its central axis is parallel to the trim axis 24 and by locating the opening 104 closer to the trim axis 24. Since the box 102 does not rotate about the steering axis 26 when the outboard engine 100 is steered, steering the outboard engine 100 does not cause the tube connected to the opening 104 to translate.

As can be seen in FIG. 7, the opening 106 is disposed in a top of the box 102 near a left lateral side of the box 102. Therefore, the tube 108 connected to the opening 106 extends upwardly from the opening 106. As previously described, the tube 108 extends inside a passage 110 defined by the cowling 36 and is connected at a near a top thereof. The passage 110 is located outside the engine compartment defined by the cowling 36 such that the tube 108 cannot come into contact with the engine 34. As can be seen in FIG. 7, the passage 110 has a generally reniform cross-section. Therefore, the passage 110 does not interfere with the lower end of the tube 108 when the outboard engine 100 is steered about the steering axis 26. When the outboard engine 100 is steered about the steering axis 26, the upper end of the tube 108, and therefore the portion of the lines located therein, rotate about the steering axis 26 with the outboard engine 100, and the lower end of the tube 108 does not rotate about the steering axis 26. When the outboard engine 100 is trimmed or tilted about the tilt axis 24, since both the cowling 36 and the box 102 rotate together about the tilt axis 24, the position of the tube 108 relative to the box 102 and the cowling 36 does not change.

Figure 9:
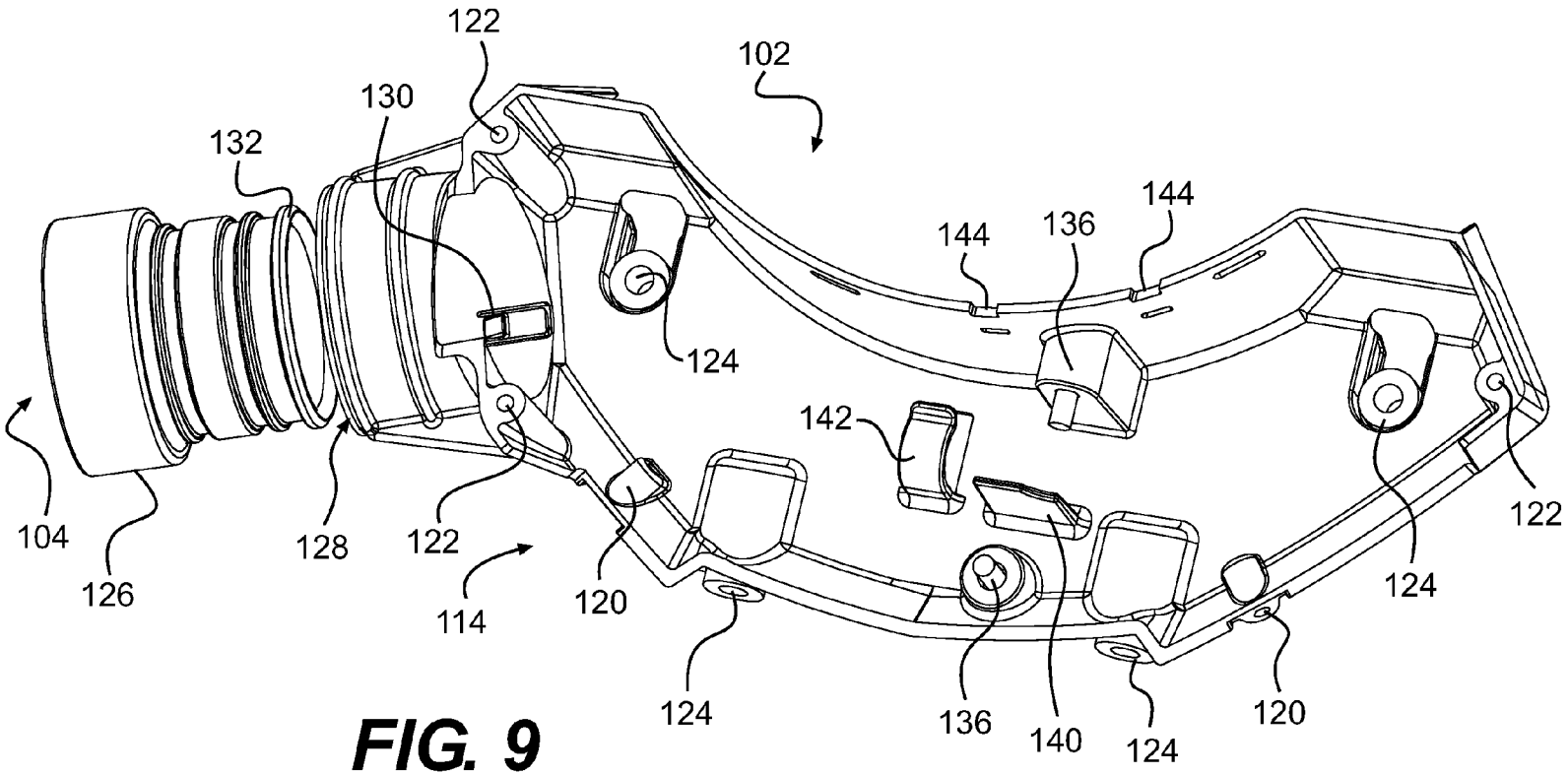
FIG. 9 is an exploded view of a lower portion and tubing adaptor of the box of FIG. 8.
Figure 10:
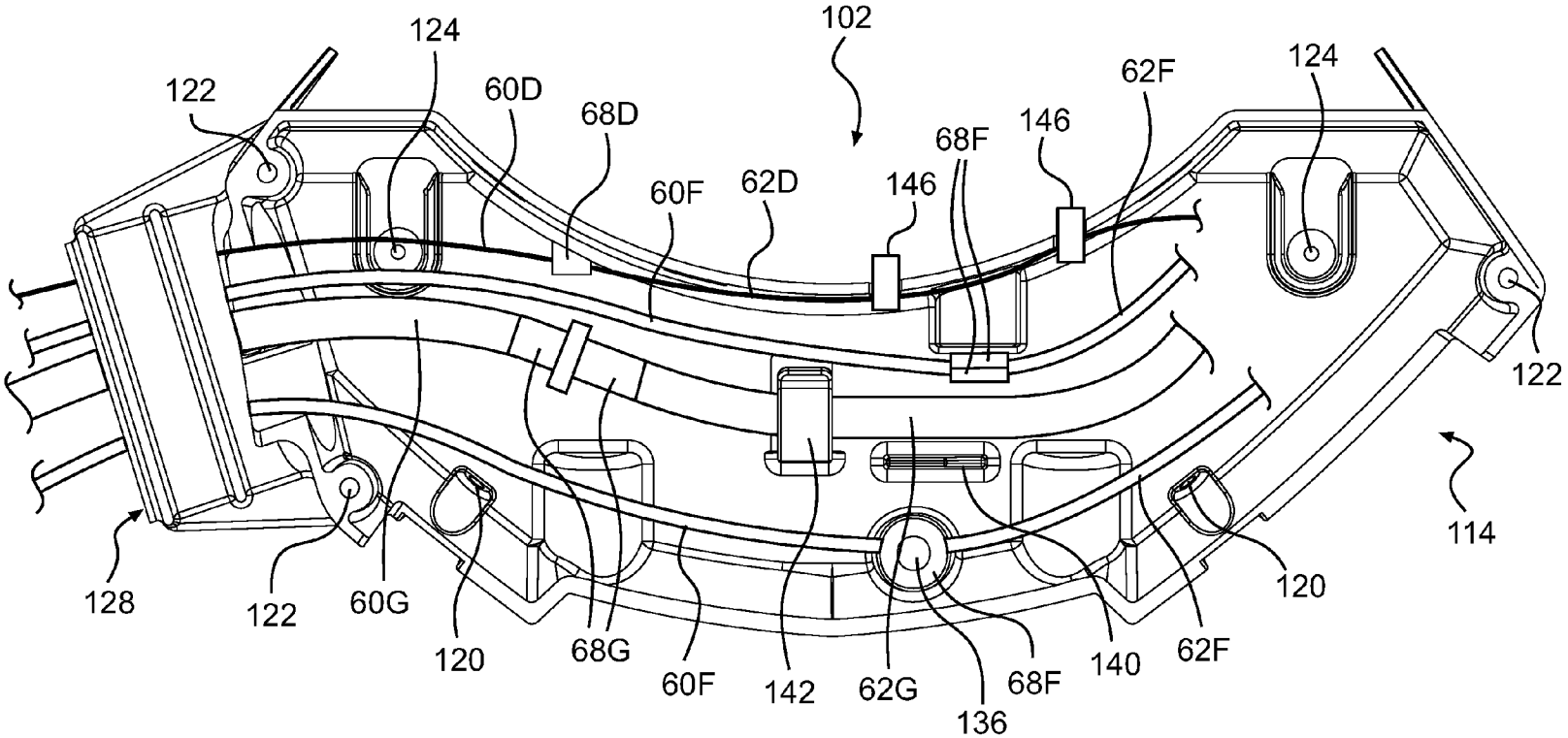
FIG. 10 is a top plan view of the lower portion and tubing adaptor of the box of FIG. 8, with various lines inserted therein.

Turning now to FIGS. 8 to 10, the box 102 will be described in more detail. The box 102 is made of plastic, but it is contemplated that it could be made of other materials such as aluminum. As can be seen in FIG. 10, the rearward portion of the box 102 is curved. The curvature of this portion of the box 102 generally corresponds to the arc defined by the portion of the cowling 36 adjacent to this portion when the outboard engine 100 is steered.

The box 102 is made of two main parts 112, 114. The part 112 has a plurality of apertures 116, 118 defined therein. The part 114 has a plurality of aperture 120, 122 defined therein. When the box 102 is assembled, the apertures 116 are aligned with the aperture 120 and the apertures 118 are aligned with the apertures 122. Fasteners (not shown) passing through each pair of apertures 116, 120 and each pair of apertures 118, 122 fastened the part 112 to the part 114.

The part 114 has four apertures 124 through which fasteners (not shown) are inserted to fasten the box 102 to the tilt/trim/steering subsystem 16.

The opening 104 is defined by a sleeve 126. The sleeve 126 is inserted in an aperture 128 formed in a lateral side of the part 114. The sleeve 126 is retained on the part 114 by a clip 130 integrally formed in the part 114 which hooks a rib 132 of the sleeve 126.

The opening 106 is defined by a flange 134 extending from the top of the part 102.

The parts 112 and 114 of the box 102 has many features to hold the various lines found therein in place. The lines and connectors described below have been labeled with the same reference numerals as those described in FIG. 2 and should be understood as being connected to the same devices. Some of the features found in the part 114 are described below. Two battery terminals 136, one for the positive pole of the battery 56F and one for the negative pole of the battery 56F, are disposed on either side of a separating wall 140. The wall 140 helps prevent contact between the ends of the electrical wires 60F and 62F during their connections. The end of the wires 60F and 62F are provided with ring connectors 68F that are disposed around the terminals 136. A clip 142 is integrally formed in the part 114 and holds the fuel hose 62G. The fuel hose 60G connects to the fuel hose 62G via fuel fittings 68G. Apertures 144 are provided in the side of the part 114 to receive tie wraps 146. The tie wraps 146 are used to hold electrical wires and cables in place, only one of which, the speedometer wire 62D, is shown.

Turning now to FIGS. 11 to 24 another embodiment of an outboard engine (outboard engine 200) will be described. Features of the outboard engine 200 which are similar to those of the outboard engine 10 described above have been labeled with the same reference numerals as in the outboard engine 10. Also, for simplicity, these features will not be described again in detail. Note that in FIGS. 13A to 15B and FIGS. 17A to 19B a portion of the cowling 36 and the engine 34 have been removed in order to facilitate understanding of the movement of the cowling 36 relative to a box 202 of the outboard engine 200.

Figure 11:
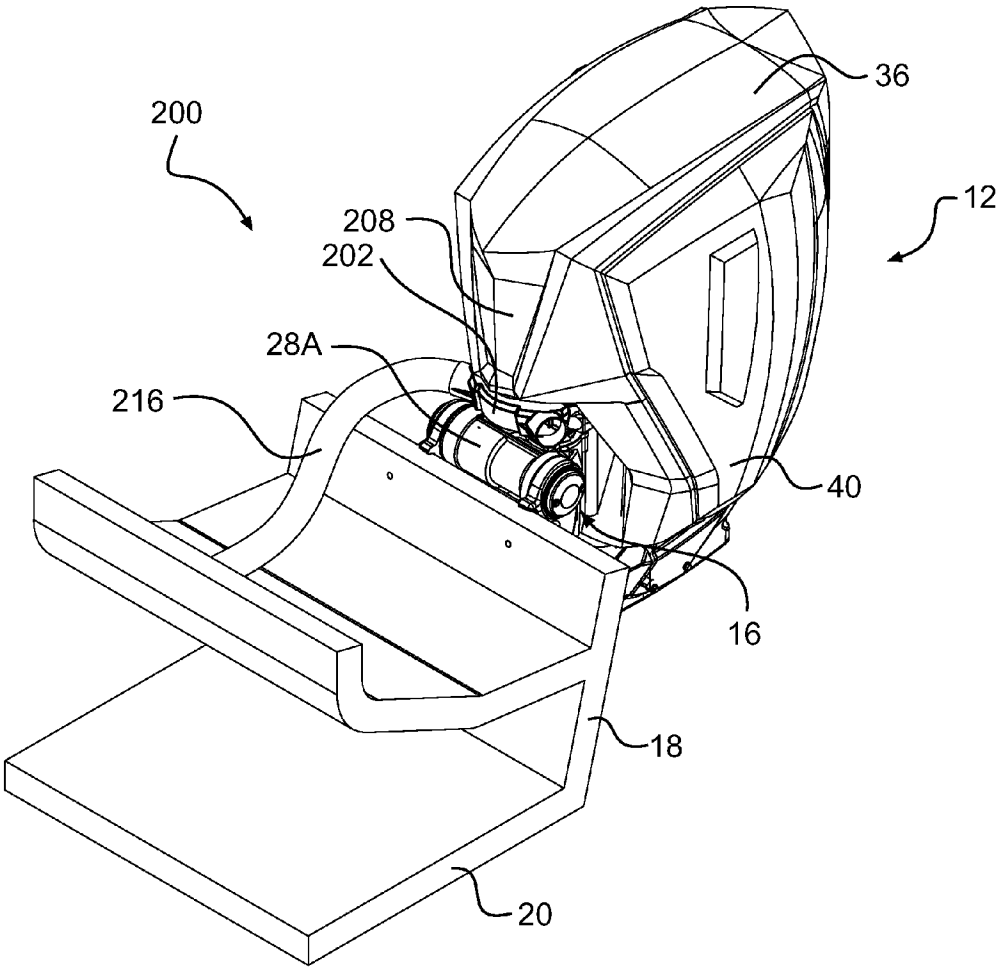
FIG. 11 is a perspective view taken from a front, left side of an outboard engine according to another embodiment.
Figure 12:
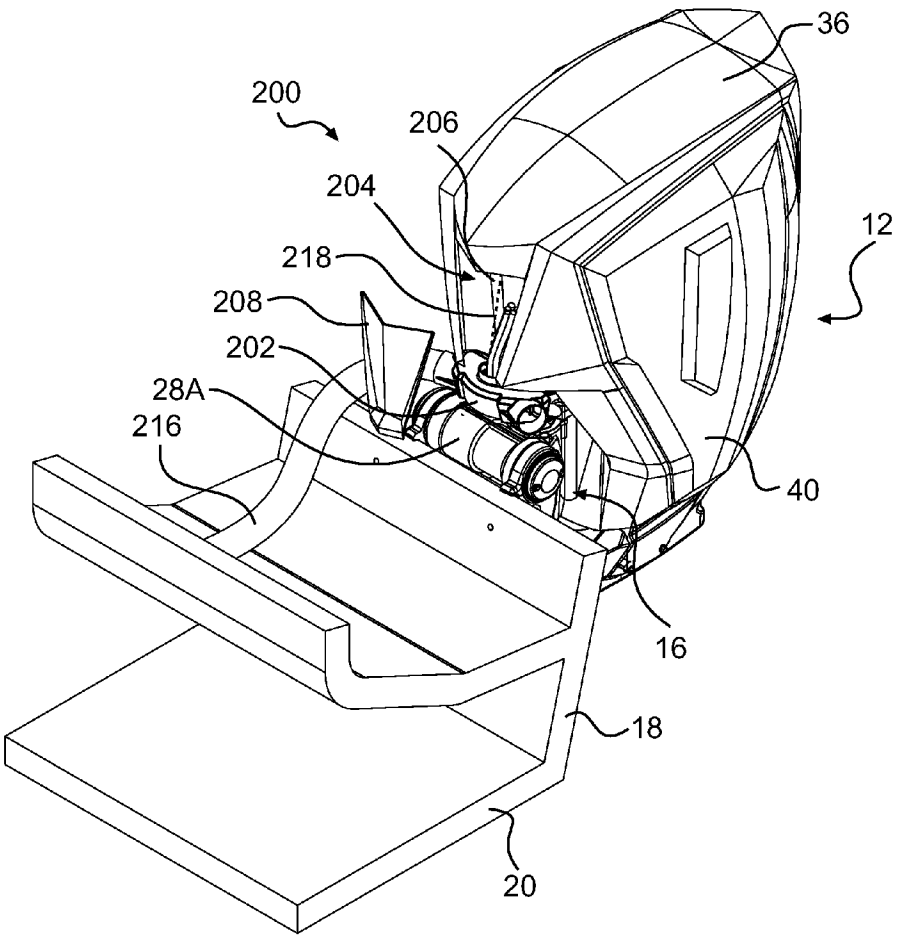
FIG. 12 is a perspective view taken from a front, left side of the outboard engine of FIG. 11, with a cover of a box formed by a cowling of the outboard engine being removed from the box.
Figure 13B:
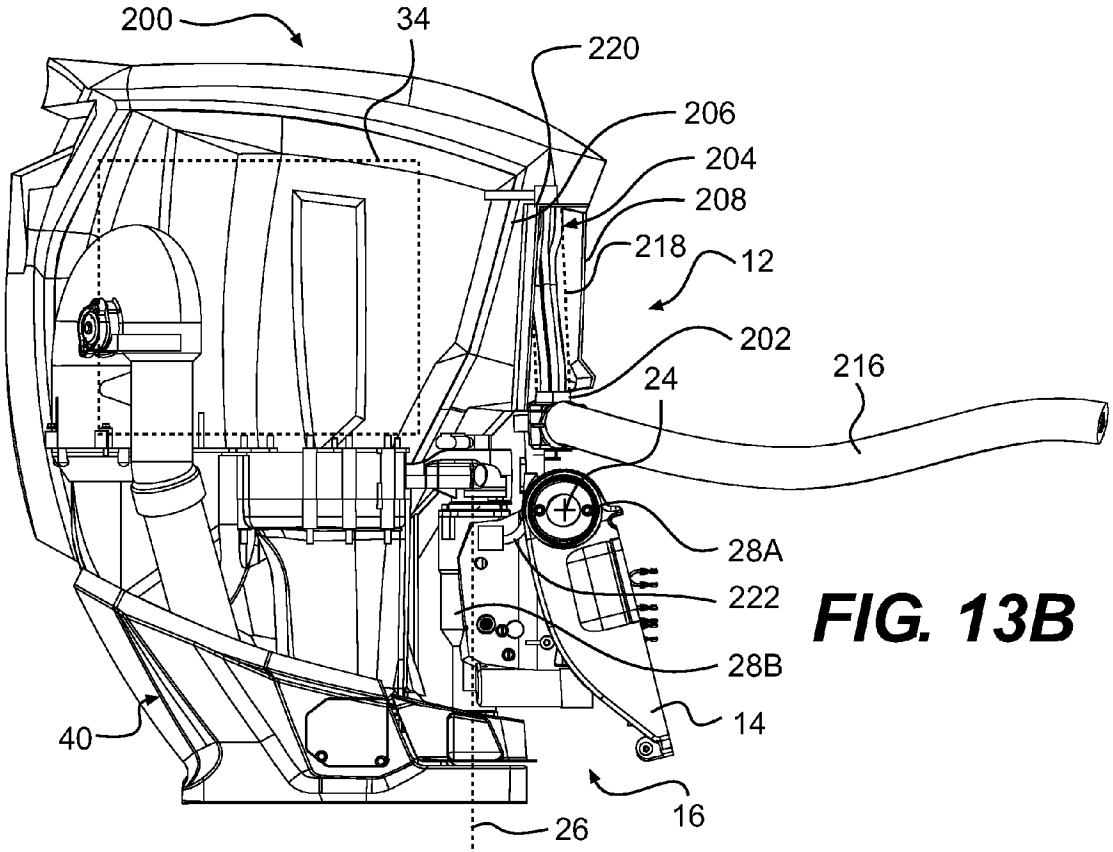
FIG. 13B is a right side elevation view of the partial cross-section of the outboard engine of FIG. 13A.
Figure 13A:
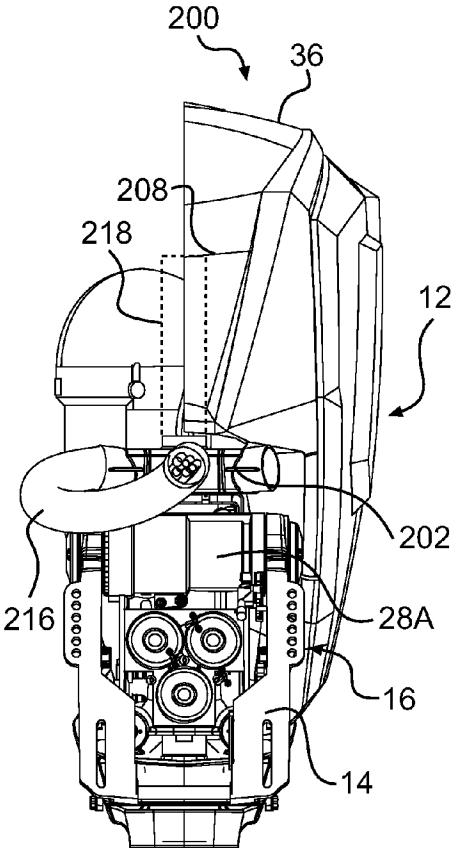
FIG. 13A is a front elevation view of a partial cross-section of the outboard engine of FIG. 11 shown in a tilt down position and a straight ahead steering position.
Figure 14B:
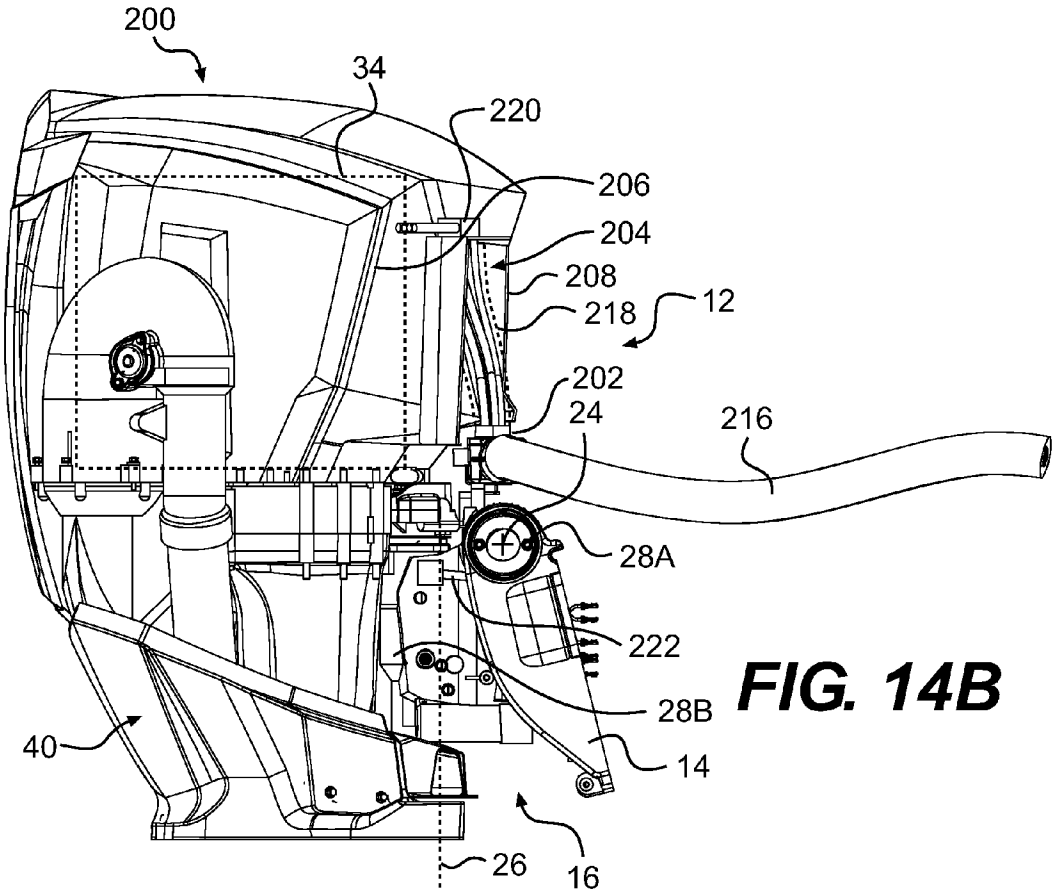
FIG. 14B is a right side elevation view of the partial cross-section of the outboard engine of FIG. 14A.
Figure 14A:
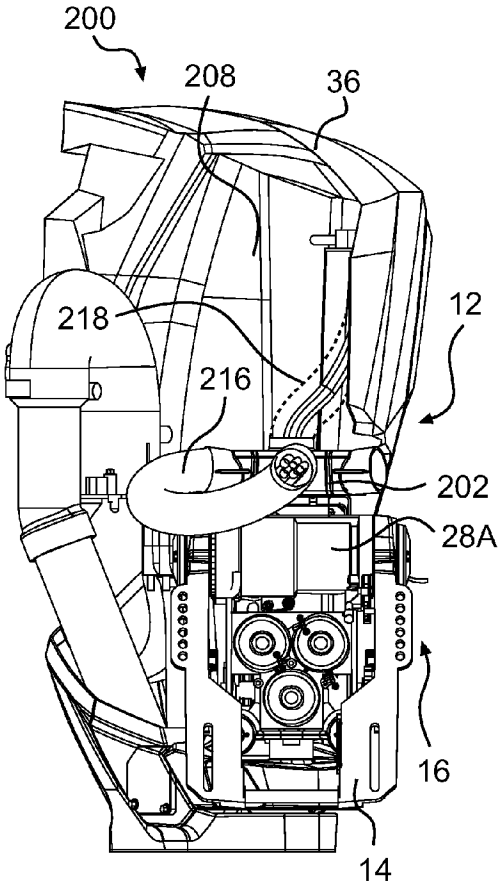
FIG. 14A is a front elevation view of a partial cross-section of the outboard engine of FIG. 11 shown in a tilt down position and steered to make a right turn.
Figure 15B:
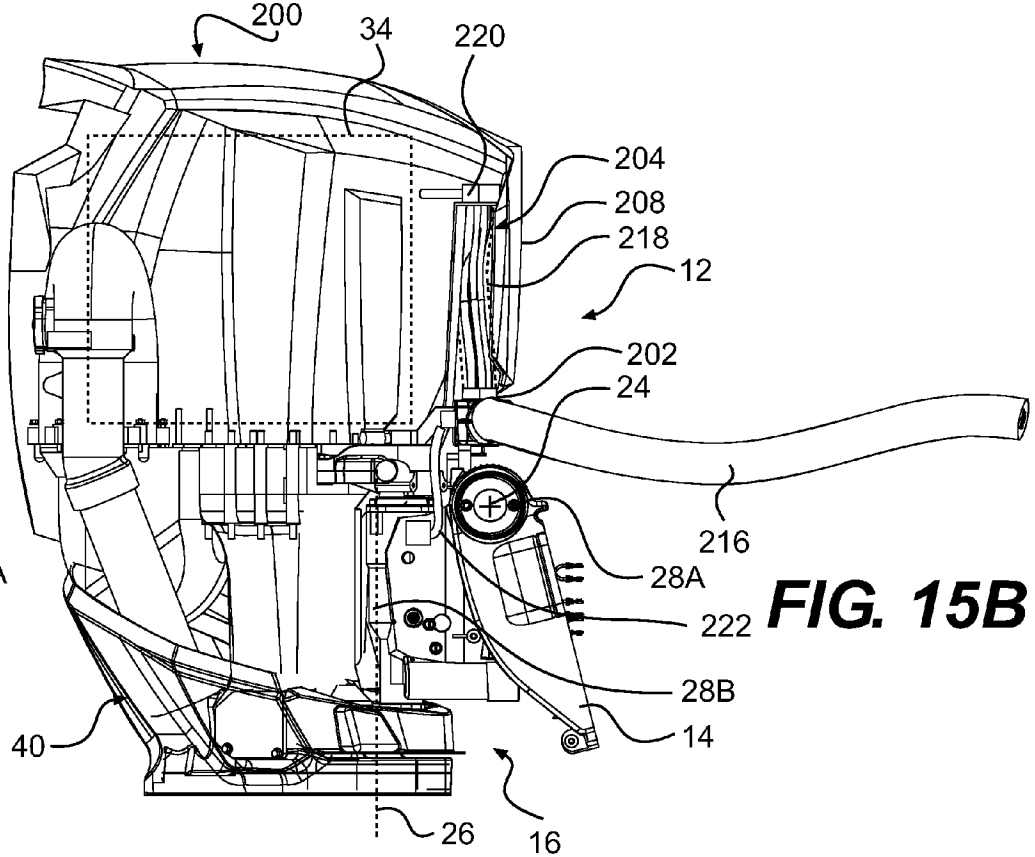
FIG. 15B is a right side elevation view of the partial cross-section of the outboard engine of FIG. 15A.
Figure 15A:
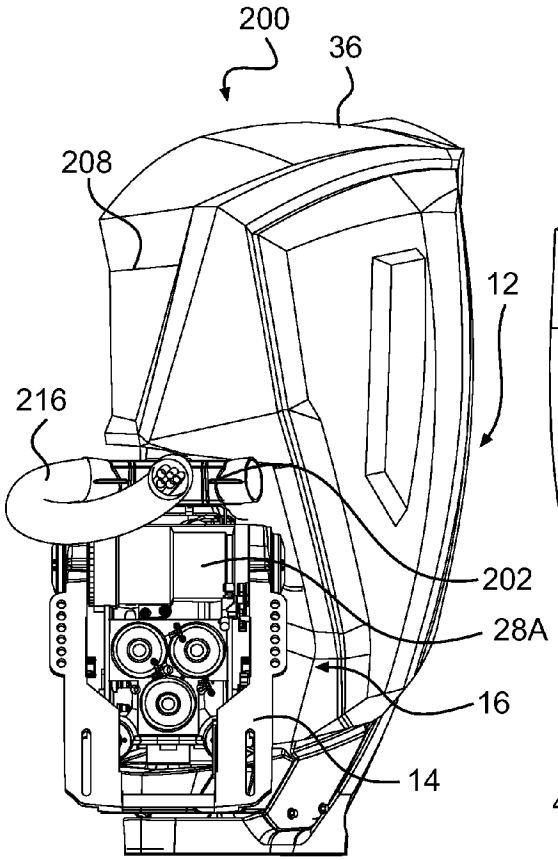
FIG. 15A is a front elevation view of a partial cross-section of the outboard engine of FIG. 11 shown in a tilt down position and steered to make a left turn.
Figure 16:
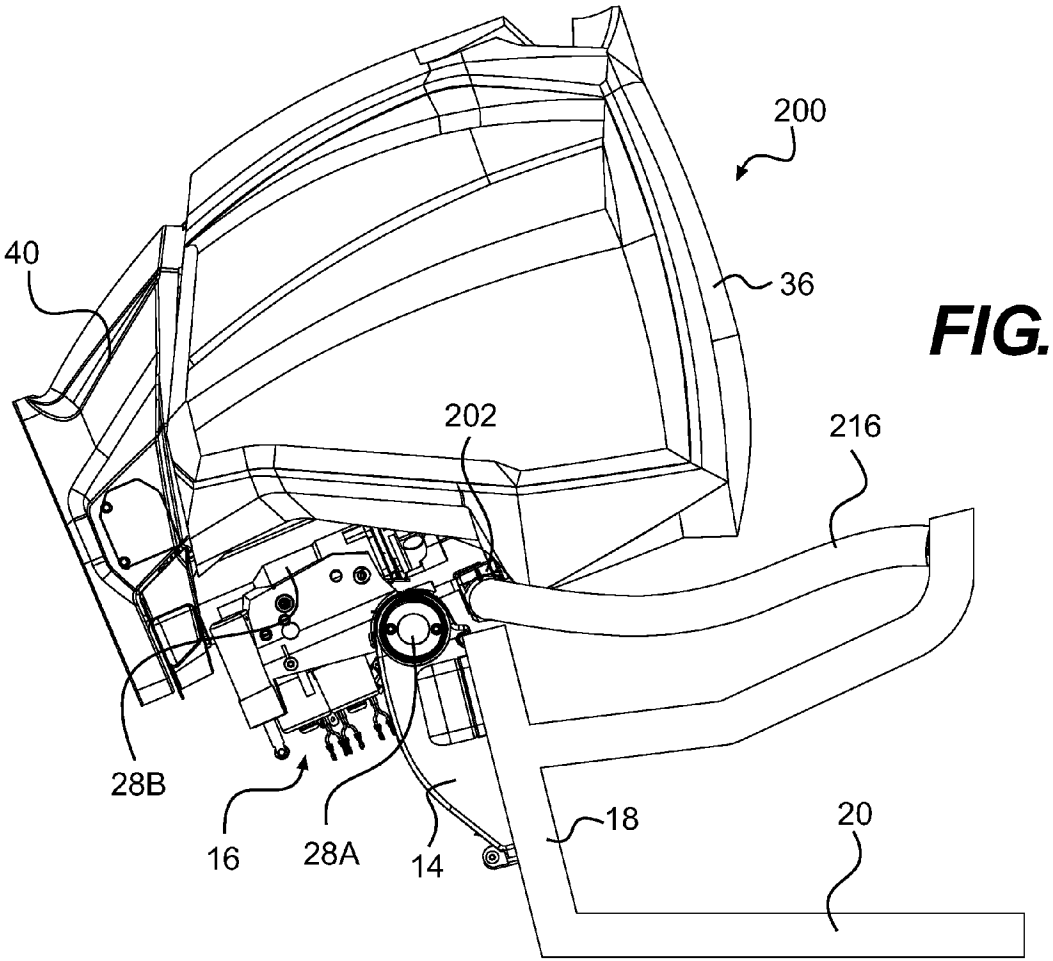
FIG. 16 is a right side elevation view of the outboard engine of FIG. 11 in a tilt up position.
Figure 17B:
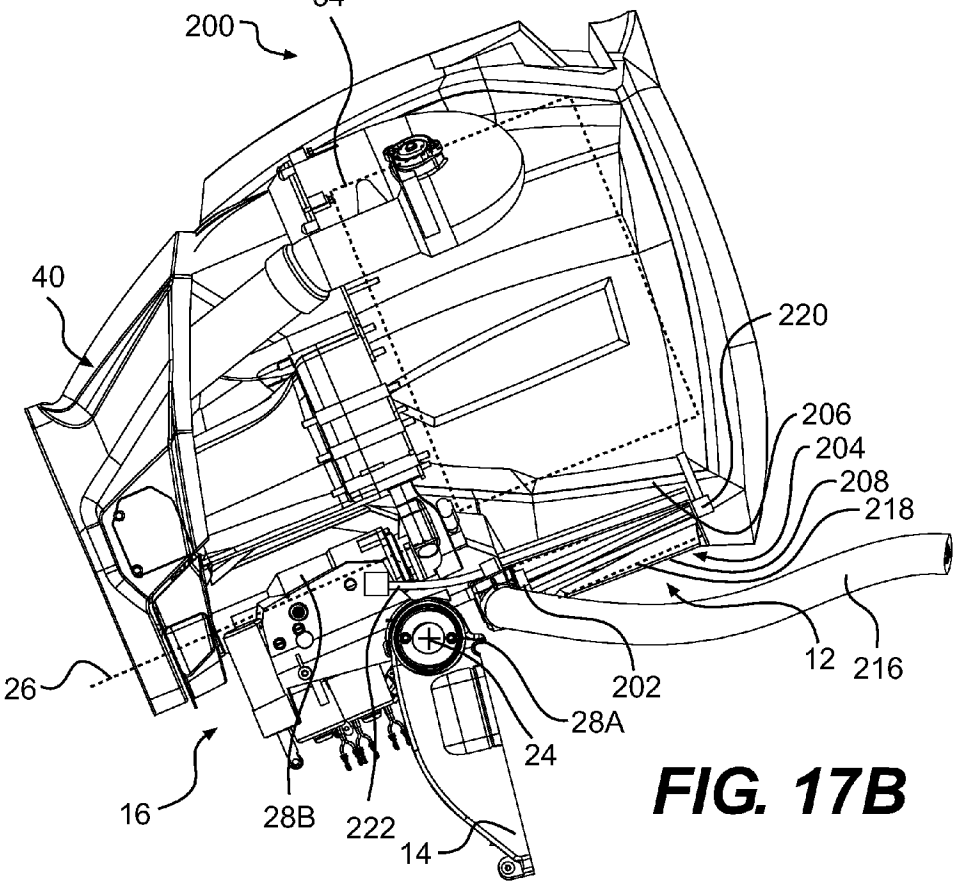
FIG. 17B is a right side elevation view of the partial cross-section of the outboard engine of FIG. 17A.
Figure 17A:
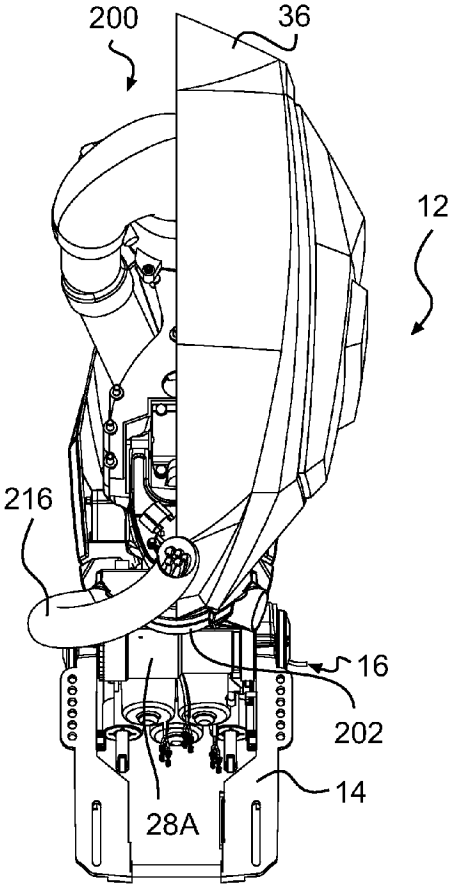
FIG. 17A is a front elevation view of a partial cross-section of the outboard engine of FIG. 11 shown in a tilt up position and a straight ahead steering position.
Figure 18B:
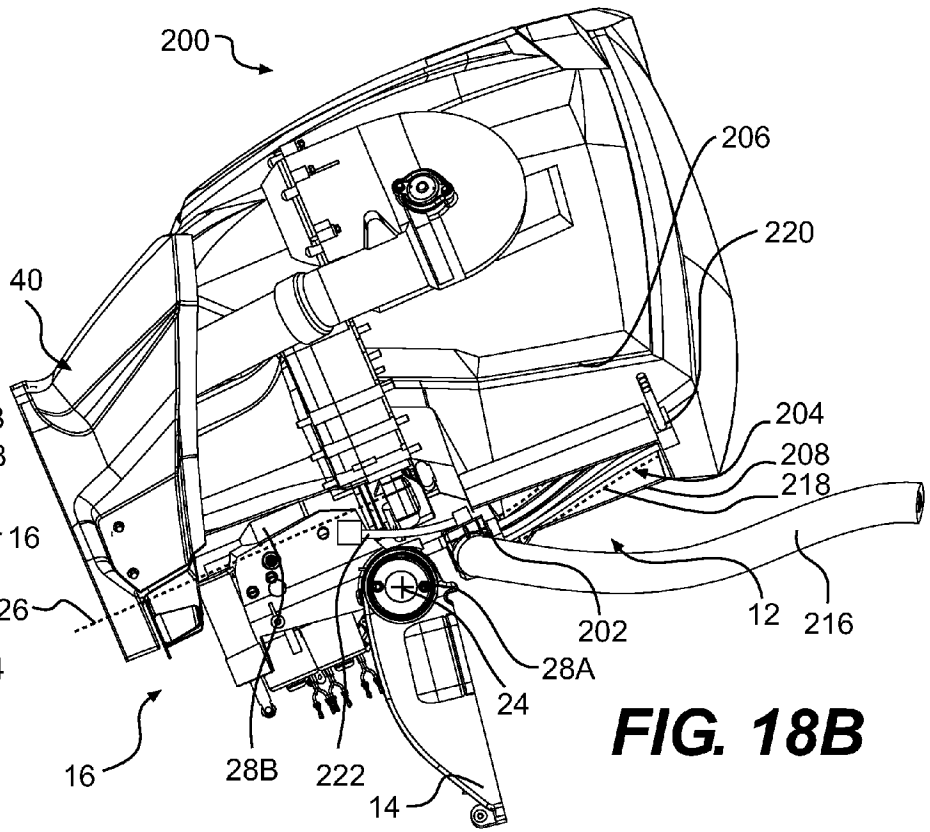
FIG. 18B is a right side elevation view of the partial cross-section of the outboard engine of FIG. 18A.
Figure 18A:
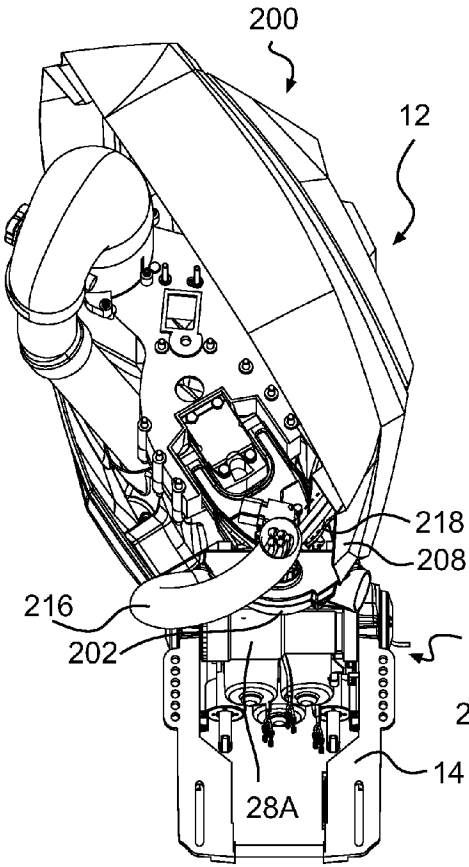
FIG. 18A is a front elevation view of a partial cross-section of the outboard engine of FIG. 11 shown in a tilt up position and steered to make a right turn.
Figure 19B:
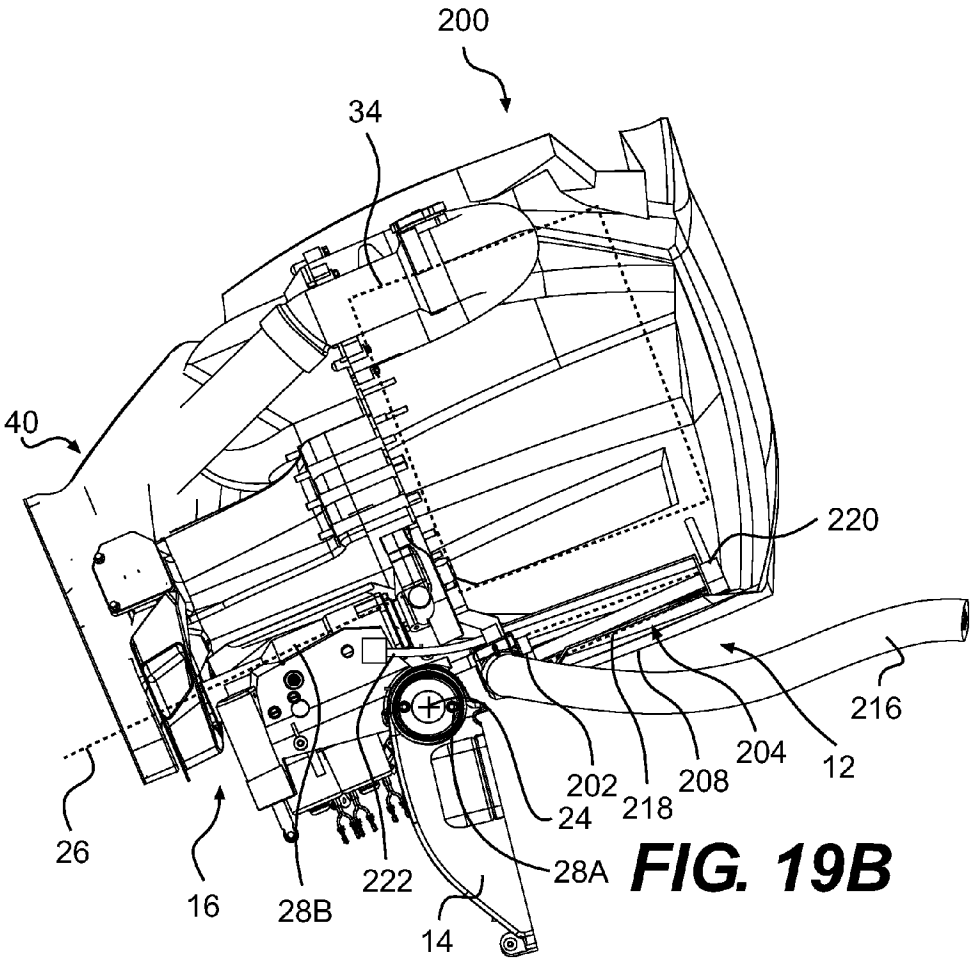
FIG. 19B is a right side elevation view of the partial cross-section of the outboard engine of FIG. 19A.
Figure 19A:
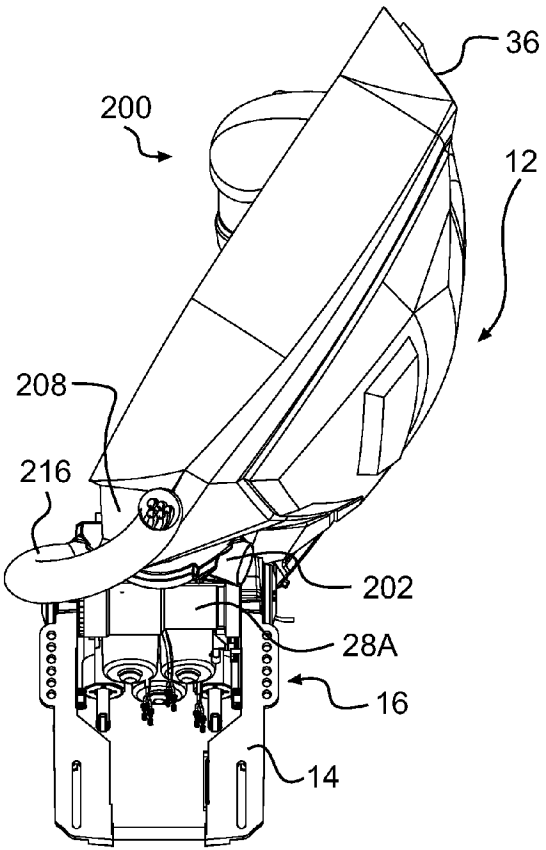
FIG. 19A is a front elevation view of a partial cross-section of the outboard engine of FIG. 11 shown in a tilt up position and steered to make a left turn.

As mentioned above, the outboard engine 200 is provided with a box 202. The outboard engine 200 is also provided with a box 204. It is contemplated that more than two boxes could be provided. The box 202 is mounted on top of the integrated tilt/trim/steering subsystem 16 and is connected to the stern bracket 14 thereby. It is contemplated that the box 202 could be connected directly to the stern bracket 14. As best seen in FIG. 13B, the box 202 is disposed forwardly of the steering axis 26. By positioning the box 202 in this manner, the box 202 pivots about the tilt axis 24 when the outboard engine 200 is trimmed or tilted as can be seen by comparing FIGS. 11 to 15B to FIGS. 16 to 19B. However, the box 202 does not turn about the steering axis 26 when the outboard engine 200 is steered as can be seen in FIGS. 14A to 15B and 18A to 19B. The box 204 is formed by the cowling 36 on a forward portion of the outboard engine 200 above the box 202 and has an opening at a bottom thereof. The box 204 is disposed externally of the engine compartment. A front of the engine compartment is defined by cowling wall 206 (FIG. 13B). The box 204 has a removable front panel 208 which can be removed, as shown in FIG. 12, to provide access inside the box 204 to permit a user to connect lines together therein. It is contemplated that the box 204 could be a box formed separately from the cowling 36 and connected to the engine compartment directly, either inside or outside the cowling 36.

As best seen in FIG. 21, the box 202 has three openings 210, 212 and 214. A tube 216 is connected to the opening 210 and extends to the watercraft to which the outboard engine 200 is connected. A plurality of lines is disposed inside the tube 216 and extends from the box 202 to be connected to devices located in the watercraft. A tube 218 (shown in phantom) is connected between the opening 214 and an opening 220 located at a top of the box 204. A plurality of lines is disposed inside the tube 218 and extends from the box 202 to be connected to devices located in the engine compartment defined by the cowling 36. It is contemplated that the tubes 216 and 218 could be omitted and that the lines could be bundled together by tie wraps for example. As in the embodiment of FIG. 3, some of the lines disposed in the tube 216 are connected at one end to devices in the watercraft and the other end to corresponding lines in the box 202, and these corresponding lines extend from the box 202 inside the tube 218 and pass through the box 204 to be connected to devices inside the engine compartment. Also as in the embodiment of FIG. 3, other lines disposed in the tube 216 are connected at one end to devices in the watercraft, pass through the box 202, and are connected at the other end to corresponding lines inside the box 204, and these corresponding lines extend from the box 204 to the engine compartment to be connected to devices inside the engine compartment. It is contemplated that the lines that are connected to each other in the box 204 could be disposed inside or outside the tube 218. Hydraulic hoses 222 (only one of which is shown, see FIG. 13B) extend from the tilt/trim/steering subsystem 16 through the bottom of the box 202 where they are connected to corresponding hydraulic lines that extend to the watercraft via opening 210. In the embodiment shown, no tube is connected to the opening 212 since no lines extend therethrough. As such, in this embodiment, the opening 212 is capped. However, it is contemplated that lines could extend through both openings 210, 212, in which case a tube would be connected to the opening 212. It is also contemplated that lines could extend through the opening 212 and not through the opening 210, in which case a tube would be connected to the opening 212 and the opening 210 would be capped. For example, for a watercraft having two outboard engines 200 disposed side by side, the outboard engine 200 on the right would have lines extending through the opening 210 of its box 202 and the outboard engine 200 on the left would have lines extending through the opening 212 of its box 202.

Figure 25:
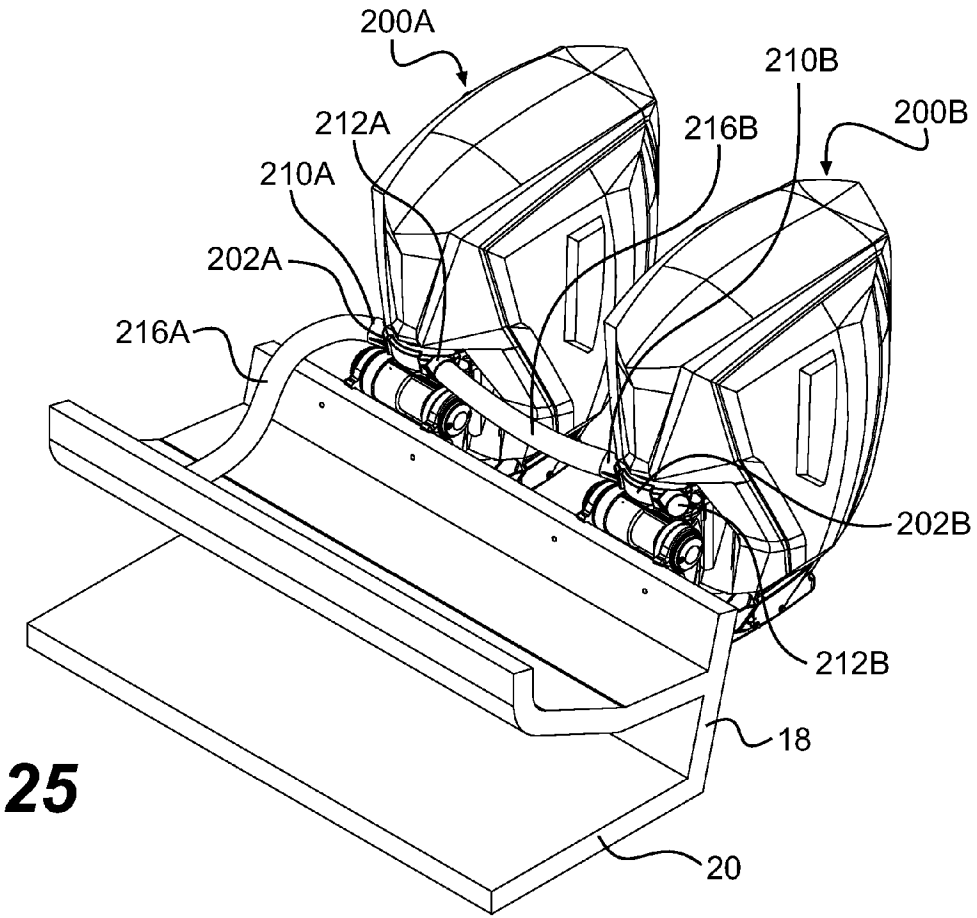
FIG. 25 is perspective view taken from a front, left side of a transom of a watercraft having a pair of outboard engine of the type shown in FIG. 11 mounted thereto.

FIG. 25 illustrates the transom 18 of a watercraft having two outboard engines 200A and 200B mounted thereto. The outboard engines 200A and 200B are the same as the outboard engine 200 described above. In this embodiment, lines extend from devices in the watercraft to the box 202A of the outboard engine 200A via the opening 210A of the box 202A. These lines are disposed in a tube 216A. Other lines connect to these lines inside the box 202A, pass through the top opening of the box 202A and are connected to devices inside the engine compartment of the outboard engine 200A in the manner described above with respect to the outboard engine 200. More lines connect to the lines coming from the watercraft inside the box 202A, pass through the opening 212A of the box 202A and enter the box 202B via the opening 210B of the box 202B. These lines are disposed in a tube 216B. Additional lines connect to these lines inside the box 202B, pass through the top opening of the box 202B and are connected to devices inside the engine compartment of the outboard engine 200B in the manner described above with respect to the outboard engine 200. The opening 212B of the box 202B is capped. It is contemplated that the lines from the devices of the watercraft could enter the opening 212B of the box 202B, in which case the opening 210A of the box 202A would be capped.

It is contemplated that lines could extend from devices in the watercraft to the box 202A of the outboard engine 200A via the opening 210A of the box 202A, pass through the opening 212A of the box 202A and enter the box 202B via the opening 210B of the box 202B. Additional lines connect to these lines inside the box 202B, pass through the top opening of the box 202B and are connected to devices inside the engine compartment of the outboard engine 200B in the manner described above with respect to the outboard engine 200.

It is contemplated that one or more lines could be connected between one or more devices in the watercraft and one or more devices located inside the engine compartment of the outboard engine 200A and simply pass through the box 202A. It is also contemplated that one or more lines could be connected between one or more devices in the watercraft and one or more devices located inside the engine compartment of the outboard engine 200B and simply pass through the box 202A first, and then the box 202B.

Figure 20:
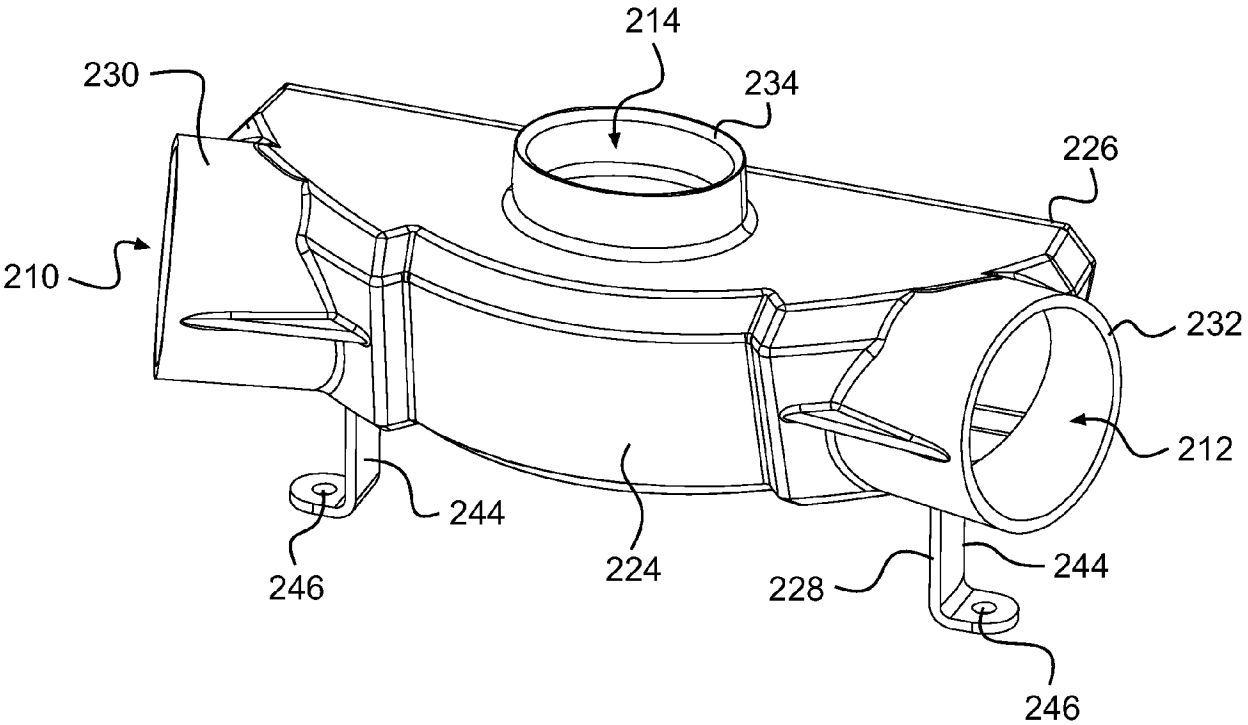
FIG. 20 is a perspective view taken from a front, left side of a box of the outboard engine of FIG. 11.
Figure 24:
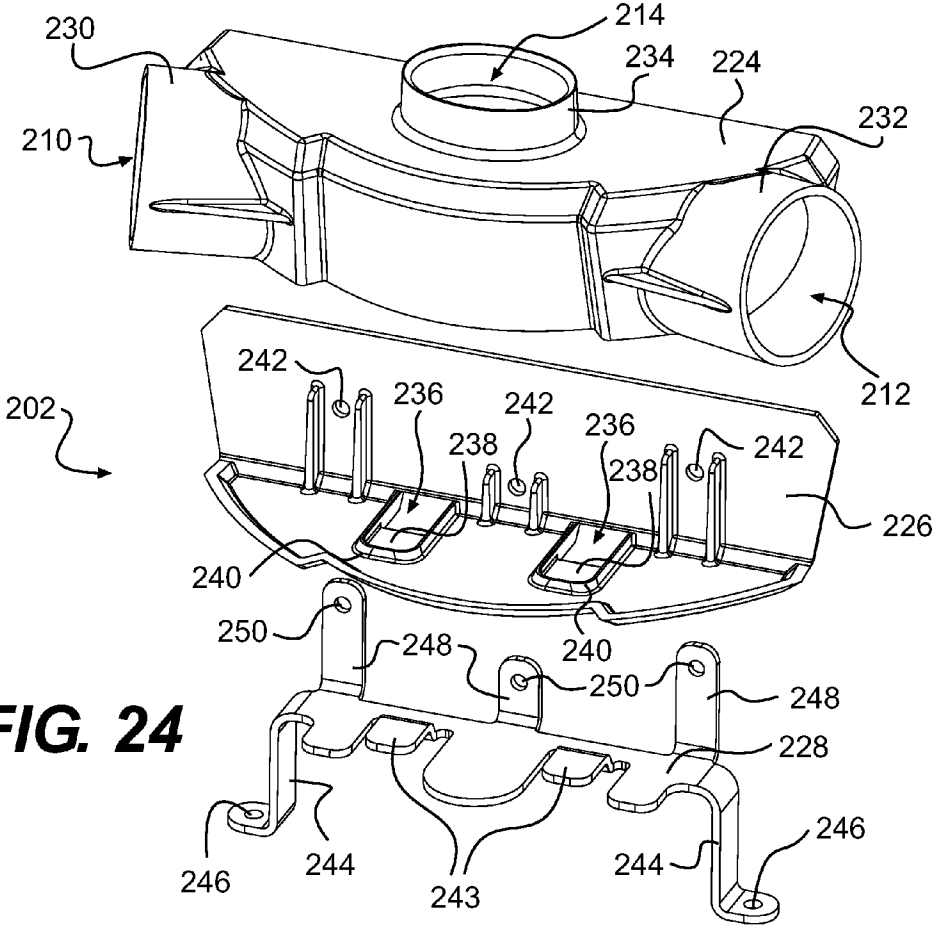
FIG. 24 is an exploded view of the box of FIG. 20.

As can be seen in FIG. 20, the opening 210 is disposed on a right lateral side of the box 202. The opening 210 faces at an angle towards the front and right side of the outboard engine 200. Therefore, as can be seen in FIG. 11, the tube 216 extends from the opening 210 towards the front and right side of the outboard engine 200 and is disposed relatively close to the tilt axis 24 (see FIG. 13B). By positioning the tube 216 at this location and with this orientation, the tube 216, and therefore the lines disposed therein, does not move very much when the outboard engine 200 is trimmed or tilted about the tilt axis 24 (compare FIG. 13B to FIG. 17B for example). It is contemplated that this movement of the tube 216 could be further reduced by orienting the opening 210 such that its central axis is parallel to the trim axis 24 and by locating the opening 210 closer to the trim axis 24. Since the box 202 does not rotate about the steering axis 26 when the outboard engine 200 is steered, steering the outboard engine 200 does not cause the tube 216 to translate (compare FIG. 13A to FIGS. 14A and 15A for example). The opening 212 is a mirror image of the opening 210.

As can be seen in FIG. 20, the opening 214 is disposed in a top of the box 202 at lateral center thereof. Therefore, the tube 218 extends upwardly from the opening 214. As previously described, the tube 218 extends inside the box 204 and is connected at a near a top thereof. As can be seen in FIG. 12, the box 204 has a generally reniform cross-section. Therefore, the box 204 does not interfere with the lower end of the tube 218 when the outboard engine 200 is steered about the steering axis 26 (see FIGS. 14A, 15A, 18A, and 19A). When the outboard engine 200 is steered about the steering axis 26, the upper end of the tube 218, and therefore the portion of the lines located therein, rotate about the steering axis 26 with the outboard engine 200, and the lower end of the tube 218 does not rotate about the steering axis 26 (compare FIG. 13A to FIG. 14A for example). When the outboard engine 200 is trimmed or tilted about the tilt axis 24, since both the cowling 36 and the box 202 rotate together about the tilt axis 24, the position of the tube 218 relative to the box 202 and the cowling 36 does not change (compare FIGS. 13B, 14B, and 15B to FIGS. 17B, 18B, and 19B respectively for examples).

Turning now to FIGS. 20 to 24, the box 202 will be described in more detail. The box 202 has three main parts: part 224, part 226, and bracket 228. The part 224 has the openings 210, 212 and 214 defined therein. The openings 210, 212 and 214 are formed by generally cylindrical flanges 230, 232 and 234 respectively of the part 224. The part 226 has two apertures 236 in a bottom thereof. The apertures 236 are disposed adjacent to tabs 238. Ribs 240 surround the apertures and tabs 238. The part 226 also has three apertures 242 defined therein. The part 224 has three corresponding apertures (not shown). The parts 224 and 226 are made of plastic, however it is contemplated that they could be made of other types of materials such as aluminum. The bracket 228 has two tongues 243 that are inserted through the apertures 236 of the part 226 so as to be disposed over the tabs 238 of the part 226. The tongues 243 thereby retain the part 226 on the bracket 228. The bracket 228 has two downwardly extending legs 244 having apertures 246 used to fasten the box 202 to the tilt/trim/steering subsystem 16. The bracket also has three upwardly extending legs 248 having apertures 250. When the box 202 is assembled, the apertures 250 are aligned with the apertures 242 of the part 226 and the corresponding apertures of the part 224. Fasteners (not shown) are inserted through these apertures to fasten the parts 224, 226 and the bracket 228 together. The bracket 228 is made of metal, such as aluminum for example, however it is contemplated that the bracket could be made of other materials such as plastic.

Figure 26:
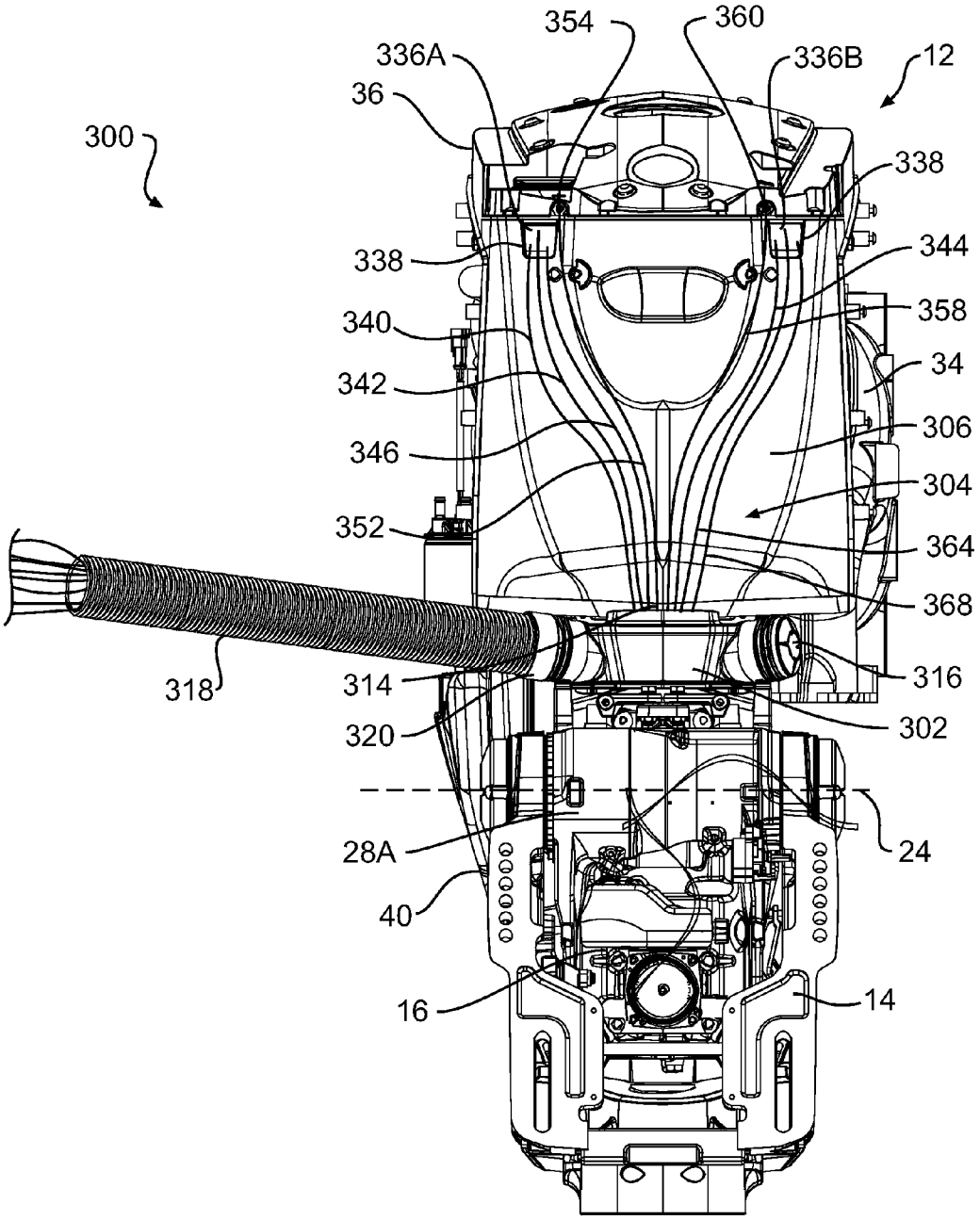
FIG. 26 is a front elevation view of an outboard engine according to another embodiment, with a cover of a box formed by a cowling of the outboard engine being removed from the box.
Figure 27:
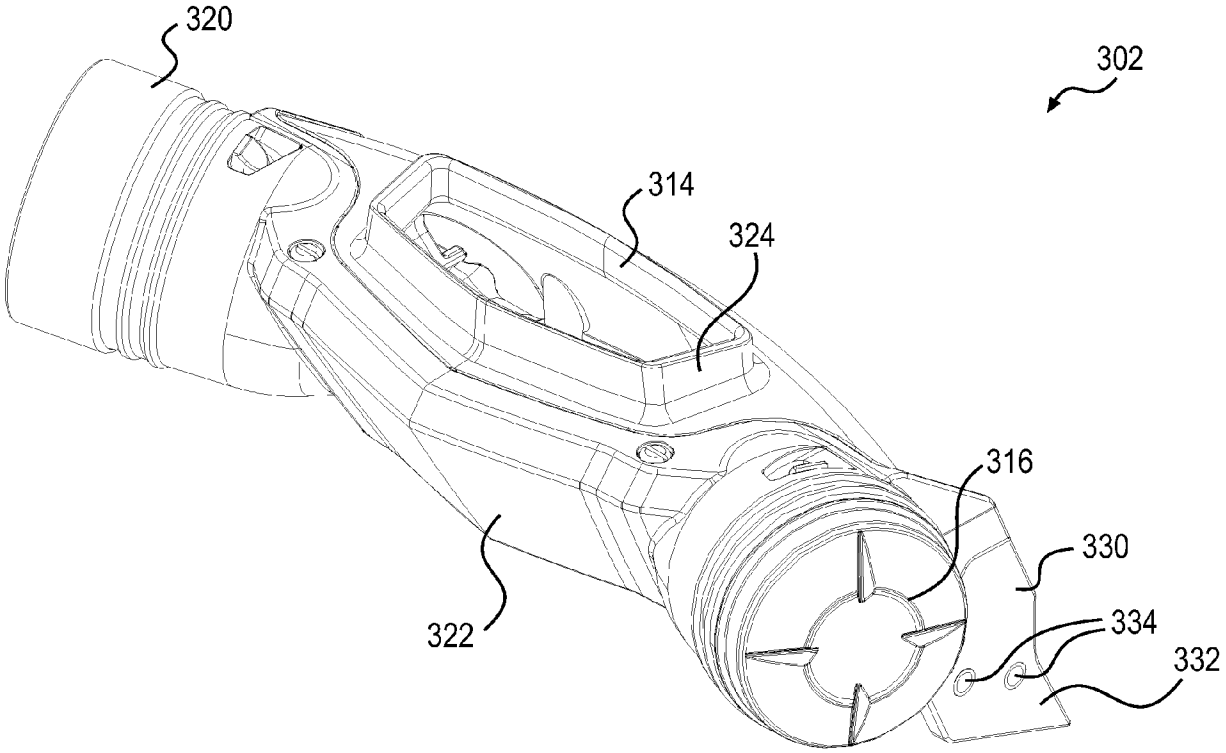
FIG. 27 is a perspective view taken from a front, left side of a box of the outboard engine of FIG. 26.
Figure 28:
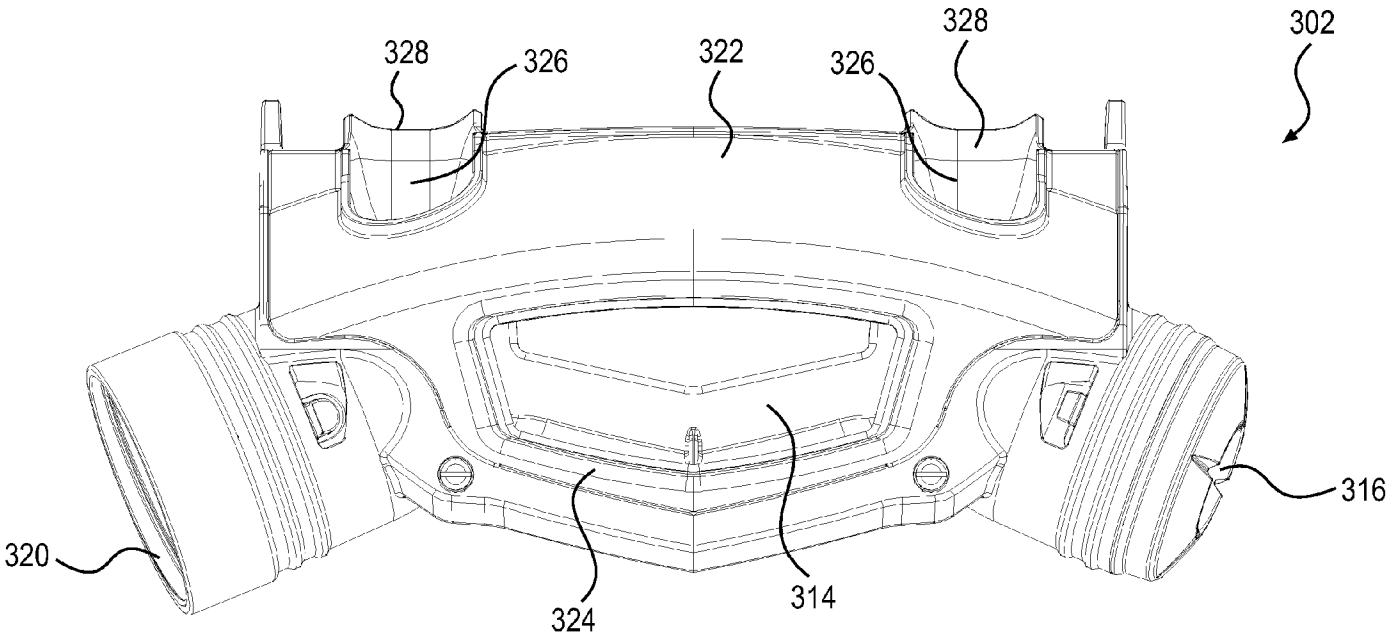
FIG. 28 is a top plan view of the box of FIG. 26.

Turning now to FIG. 26 another embodiment of an outboard engine (outboard engine 300) will be described. Features of the outboard engine 300 which are similar to those of the outboard engine 10 described above have been labeled with the same reference numerals as in the outboard engine 10. Also, for simplicity, these features will not be described again in detail. Note that in FIG. 26 portions of the cowling 36 and a removable front panel have been removed in order to facilitate understanding of the routing of the lines in the outboard engine 300. The cowling 36 and the removable cover of the outboard engine 300 are similar to the cowling 36 and the removable panel 208 of the outboard engine 200.

The outboard engine 300 is provided with a box 302. The outboard engine 300 is also provided with a box 304. It is contemplated that more than two boxes could be provided. The box 302 is mounted on top of the integrated tilt/trim/steering subsystem 16 and is connected to the stern bracket 14 thereby. It is contemplated that the box 302 could be connected directly to the stern bracket 14. The box 302 is disposed forwardly of the steering axis (not shown). By positioning the box 302 in this manner, the box 302 pivots about the tilt axis 24 when the outboard engine 300 is trimmed or tilted. However, the box 302 does not turn about the steering axis 26 when the outboard engine 300 is steered. The box 304 is similar to the box 204 shown in FIG. 12 and described above. The box 304 is formed by the cowling 36 on a forward portion of the outboard engine 300 above the box 302 and has an opening at a bottom thereof. The box 304 is disposed externally of the engine compartment. A front of the engine compartment is defined by cowling wall 306. The box 304 has a removable front panel (not shown, but similar to the panel 208 shown in FIG. 12 and described above) which can be removed to provide access inside the box 304 to permit a user to connect lines together therein and/or route lines therethrough. It is contemplated that the box 304 could be a box formed separately from the cowling and connected to the engine compartment directly, either inside or outside the cowling.

Figure 29:
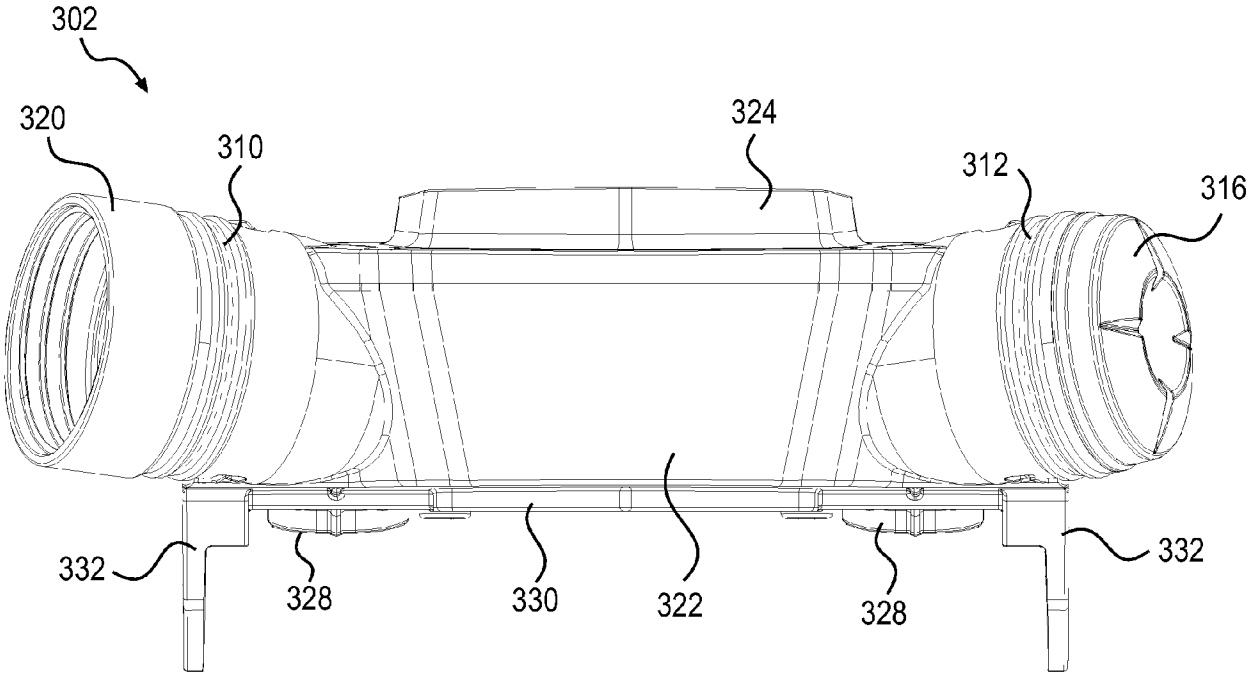
FIG. 29 is a front elevation view of the box of FIG. 26.
Figure 30:
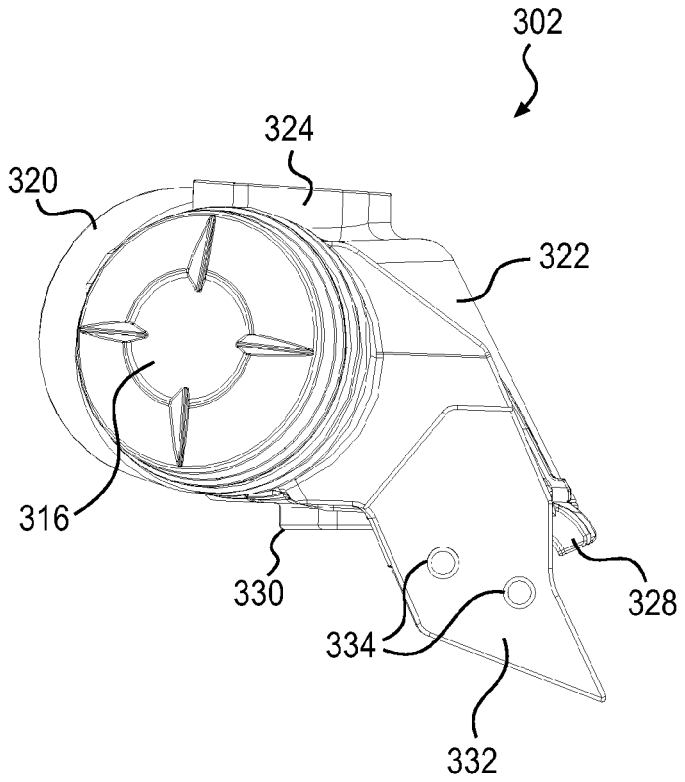
FIG. 30 is a left side elevation view of the box of FIG. 26.

The box 302 has three openings 310, 312 (see FIG. 29) and 314. A flange 320 is disposed around and extends from the opening 310. The opening 312 is closed by a cap 316. As can be seen in FIG. 26, a tube 318 is connected to the flange 320 and extends to a watercraft to which the outboard engine 300 is connected. As will be explained in greater detail below, a plurality of lines are operatively connected to devices located in the watercraft, pass inside the tube 318, then pass inside the box 302 through the opening 310, leave the box 302 via the opening 314, pass through the box 304 and are operatively connected to devices located in the engine compartment defined by the cowling 36. It is contemplated that the orientation of the tube 318 and the flange 320 could be different than the one illustrated in order to avoid interference with portion of a watercraft to which the outboard engine 300 is to be mounted. It is contemplated that the tube 318 could be omitted and that the lines could be bundled together by tie wraps for example. As previously mentioned, in this embodiment, the opening 312 is capped by cap 316, since no lines extend therethrough. However, it is contemplated that lines could extend through both openings 310, 312, in which case a tube would be connected to a flange mounted around the opening 312. It is also contemplated that lines could extend through the opening 312 and not through the opening 310, in which case a tube would be connected to a flange mounted around the opening 312 and the opening 310 would be capped by cap 316. For example, for a watercraft having two outboard engines 300 disposed side by side, the outboard engine 300 on the right would have lines extending through the opening 310 of its box 302 and the outboard engine 300 on the left would have lines extending through the opening 312 of its box 302. It is also contemplated that instead of providing a cap 316 on one of the opening 310, 312, that one of the openings 310, 312 could be omitted.

Turning now to FIGS. 27 to 30, the box 302 will be described in more detail. The flange 320 is generally cylindrical and is clipped to a central body 322 of the box 302. The cap 316 generally cylindrical and is clipped on the central body 322. It is contemplated that the flange 320 and the cap 316 could be provided with threaded surfaces which correspond to complementary threaded surfaces at the openings 310 and 312, thereby enabling the flange 320 and the cap 316 to be screwed onto the box 302. It is also contemplated that the flange 320 and the cap 316 could be integrally formed with the central body 322 of the box 302. The opening 314 is formed by a generally trapezoidal flange 324 extending from the central body 323 of the box 302. The box 302 has two apertures 326 (FIG. 29) at a bottom of a rear wall thereof. Downwardly extending tabs 328 extend from a bottom of the apertures 326. The apertures 326 permit the passage of lines into the box 302 from the tilt/trim/steering subsystem 16 and can also act as water drains for the box 302. A bracket 330 is fastened to a bottom of the box 302. The bracket 330 has two downwardly extending legs 332 having apertures 334 used to fasten the box 302 to the tilt/trim/steering subsystem 16.

Figure 31:
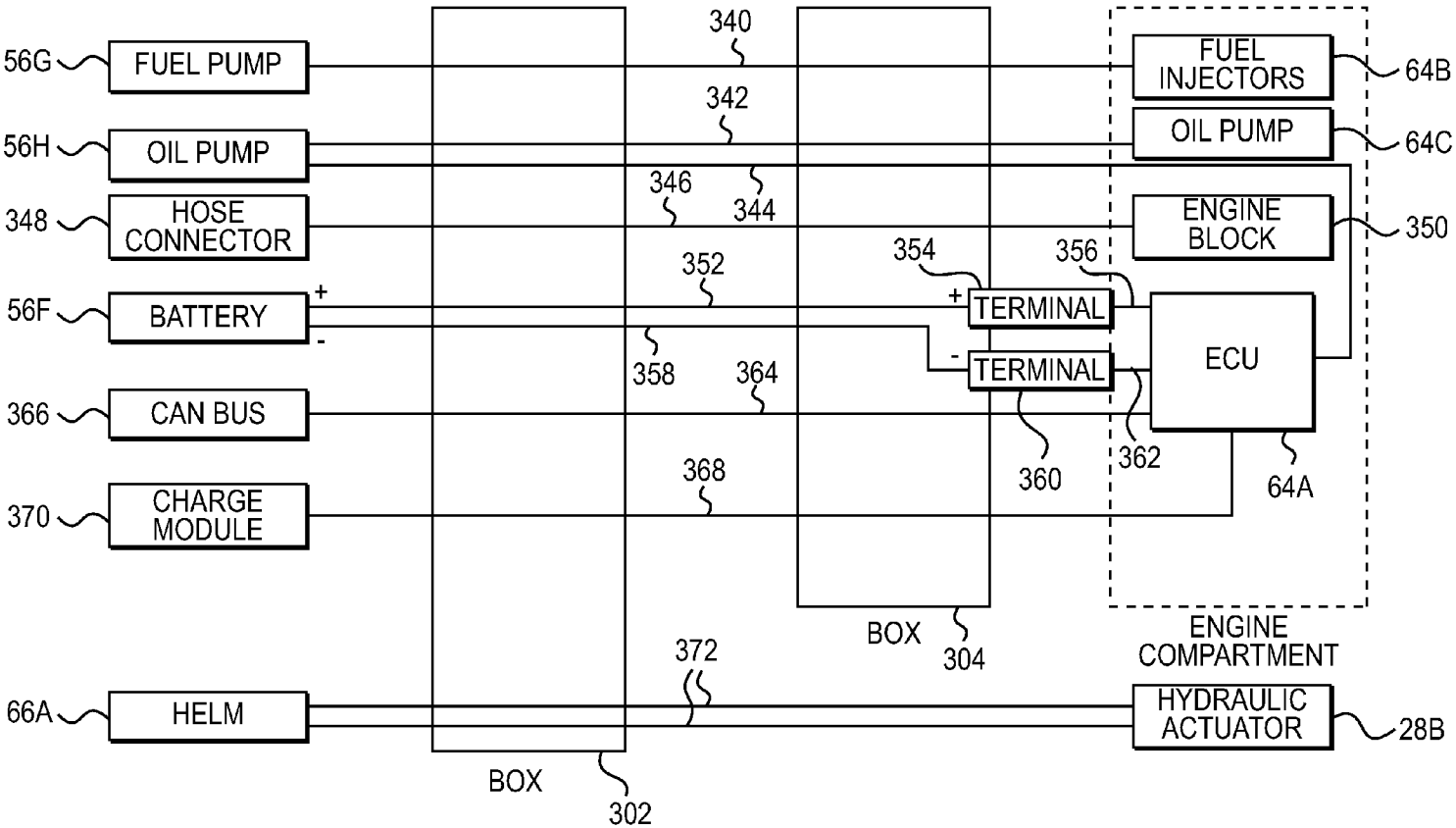
FIG. 31 is a schematic representation of an embodiment of a rigging system of the outboard engine of FIG. 26.

Turning now to FIGS. 26 and 31, an exemplary embodiment of a rigging system for the outboard engine 300 and a watercraft to which it is mounted will be described. Devices operatively connected via this rigging system which are similar to those described above with respect to the rigging systems of FIGS. 2 and 3 have been labeled with the same reference numerals as in FIGS. 2 and 3. Also, for simplicity, these devices will not be described again in detail.

As can be seen in FIG. 26, the cowling wall 306 is provided with two apertures 336A, 336B near a top thereof. The apertures 336A, 336B permit the passage of lines from the box 304 to the engine compartments. Grommets 338 are placed in the apertures 336A, 336B to help prevent water from entering the engine compartment via the apertures 336A, 336B. The grommets 338 also help prevent premature wear of the lines passing therethrough that would otherwise be caused by their rubbing against the edges of the apertures 336. It is contemplated that more or less apertures, similar to the apertures 336A, 336B, could be provided in the cowling wall 306. It is also contemplated that the lines could pass over the top of the wall 306 into a space below a top of the cowling 36 and then extend downwardly into one or more apertures in a generally horizontal surface to enter the engine compartment.

A fuel hose 340 is operatively connected at one end to the fuel pump 56G, passes through the boxes 302 and 304, enters the engine compartment via the aperture 336A and operatively connects at the other end to the fuel injectors 64B to supply them with fuel. An oil hose 342 is operatively connected at one end to the oil pump 56H, passes through the boxes 302 and 304, enters the engine compartment via the apertures 336A and operatively connects at the other end to the oil pump 64C to supply it with oil. An electrical wire or cable 344 is operatively connected at one end to the oil pump 56H, passes through the boxes 302 and 304, enters the engine compartment via the apertures 336B and operatively connects at the other end to the ECU 64A. The ECU 64A controls the operation of the oil pump 56H via the electrical wire or cable 344.

A water hose 346 is operatively connected at one end to a hose connector 348, passes through the boxes 302 and 304, enters the engine compartment via the apertures 336A and fluidly connects at the other end to cooling water passages formed in an engine block 350 of the engine 34. The hose connector 348 and hose 346 are used to flush salt from the cooling water passages of the engine block 350 after the outboard engine 300 has been used in salt-water condition. In order to do this, one needs to connect a fresh water supply to the hose connector 348 in order to supply fresh water to the cooling water passages of the engine block 350.

A first electrical wire or cable 352 is electrically connected at one end to the positive terminal of the battery 56F, passes through the box 302, enters the box 304 and electrically connects at the other end to a terminal 354 in the box 304. The terminal 354 passes through the cowling wall 306 to provide electrical connections on both sides of the wall 306. An electrical wire or cable 356 disposed inside the engine compartment is electrically connected between the terminal 354 and the ECU 64A. As such, the terminal 354 and the wire or cable 356 operatively connect the end of the wire or cable 352 to the ECU 64A. Similarly, a second electrical wire or cable 358 is electrically connected at one end to the negative terminal of the battery 56F, passes through the box 302, enters the box 304 and electrically connects at the other end to a terminal 360 in the box 304. The terminal 360 passes through the cowling wall 306 to provide electrical connections on both sides of the wall 306. An electrical wire or cable 362 disposed inside the engine compartment is electrically connected between the terminal 354 and the ECU 64A. As such, the terminal 360 and the wire or cable 3362 operatively connect the end of the wire or cable 358 to the ECU 64A.

A data transmission cable 364 is operatively connected at one end to a controlled area network (CAN) bus 366, passes through the boxes 302 and 304, enters the engine compartment via the apertures 336B and operatively connects at the other end to the ECU 64A. The CAN bus 366 receives signals from multiple devices, such as devices 56A, 56B, 56C, 56D, 56E, 70A and 70B shown in FIGS. 2 and 3, and transmits them via the single cable 364 to the ECU 64A. It is contemplated that more than one CAN bus 366 and its corresponding cable 364 could be provided.

An electrical wire or cable 368 is operatively connected at one end to a charge module 370, passes through the boxes 302 and 304, enters the engine compartment via the apertures 336B and operatively connects at the other end to the ECU 64A. The charge module 370 is disposed in the watercraft and is used to supply electric power generated by a generator (not shown) of the engine 34 to various devices. For example, the charge module 370 can be used to charge a battery of an electric trolling motor that is also mounted to the watercraft.

Hydraulic hoses 372 are operatively connected at one end to the helm 66A, enter the box 302 via the aperture 310, exit the box 302 via the apertures 326 (one hose 372 per aperture 326), and are fluidly connected at the other end to the hydraulic actuator 28B. When the helm 66A is turned, hydraulic fluid flows through the hydraulic hoses 372, which in turn actuates the actuator 28B in order to steer the outboard engine 300 in a direction corresponding to the direction in which the helm 66A has been turned.

The devices described above are only one possible example of the devices that can be associated with the outboard engine 300. It is contemplated that fewer, more, and/or different devices could be used.

As can be seen in FIGS. 26 and 31, the boxes 302 and 304 in this embodiment of a rigging system are used to route the lines 340, 342, 344, 346, 352, 358, 364, 368 and 372. However, it is contemplated that one or more of the lines 340, 342, 344, 346, 352, 358, 364, 368 and 372 could each be replaced by multiple lines, in which case it is contemplated that operative connections between these multiple lines could be located inside the box 302 and/or 304 in a manner similar to that illustrated in FIG. 3. It is also contemplated that operative connections between the multiple lines could be located between the boxes 302, 304 and their respective devices. For example, it is contemplated that one or more of the lines 344, 358 and 368 could each have one end with an operative connection to an electric harness disposed inside the engine compartment, with the one or more operative connections also being located inside the engine compartment, and with the electrical harness being connected to the ECU 64A. As such, the one or more lines 344, 358 and 368 would be operatively connected to the ECU 64A via the electrical harness.

As another example of an operative connection, the fuel hose 340 could be plugged into a connector terminal disposed along the cowling wall 306 within the box 304. The connector passes through the wall of the engine compartment and leads to another hose disposed inside the engine compartment which fluidly connects the connector, and hence the fuel hose 340, to the fuel injectors 64B. The fuel pump 56G is thereby operatively connected to the fuel injectors 64B by the fuel hose 340, via a connector and a second line (a hose in this example) within the engine compartment.

Figure 32:
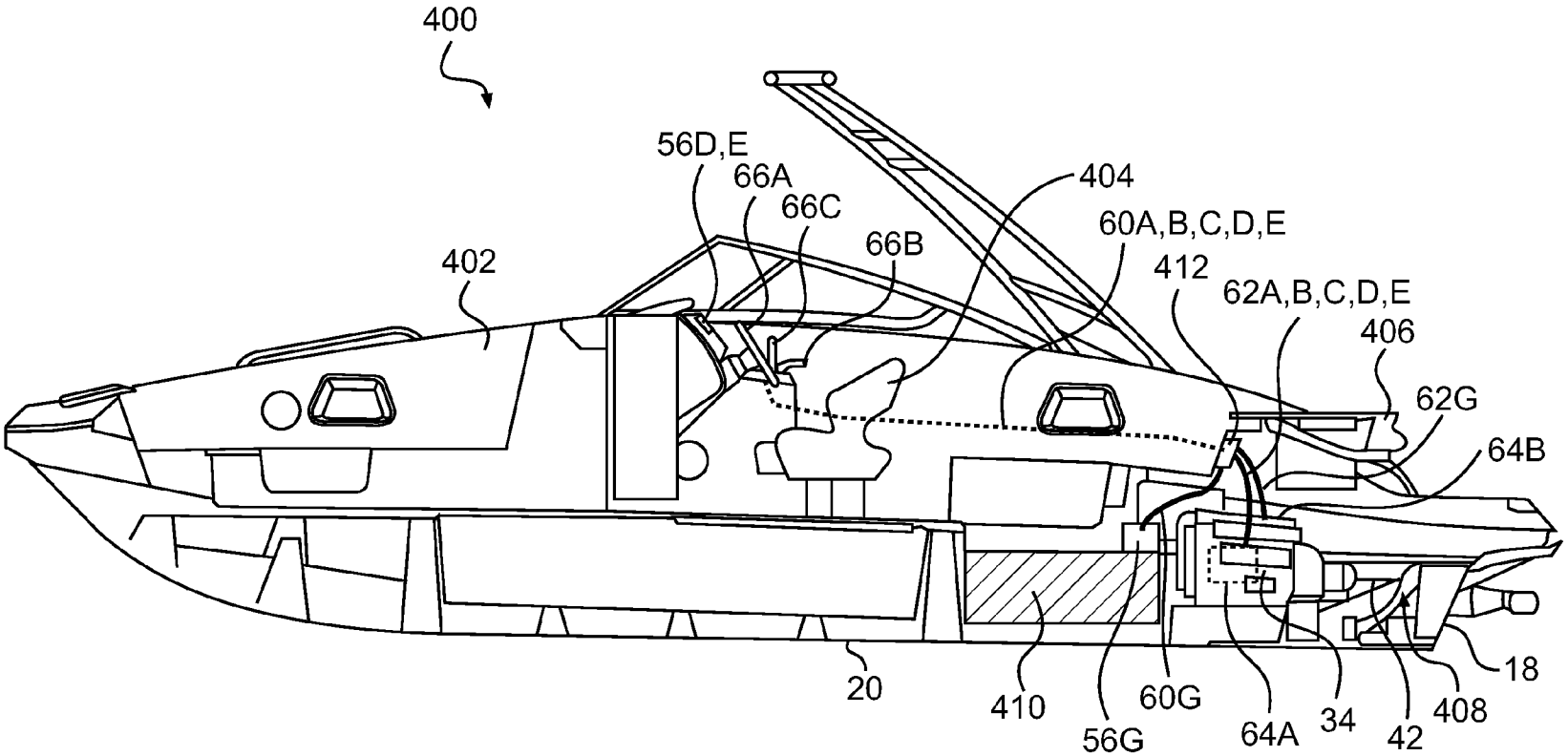
FIG. 32 is a longitudinal cross-sectional view of a watercraft having an inboard engine.

Turning now to FIG. 32, an embodiment of a watercraft 400 will be described. Features of the watercraft 400 which are similar to those described above with respect to FIGS. 1 and 2 have been labeled with the same reference numerals as in FIGS. 1 and 2. Also, for simplicity, these features will not be described again in detail.

The watercraft 400 has a hull 20 and a deck 402 disposed on top of the hull 20. A seat 404 is provided on the deck 402 for a driver of the watercraft 400 to sit on. As can be seen, the helm 66A, the throttle operator 66B, the transmission operator 66C, the speedometer 56D and tachometer 56E are disposed proximate to the seat 404 such that the driver can interact with them. The engine 34 is disposed inside an engine compartment defined between the hull 20 and the deck 402. A hinged cover 406 mounted to the deck 402 permits access to the engine 34 and other devices located in the engine compartment. The engine 34 is connected via the driveshaft 42 to a jet propulsion system 408 which includes an impeller. It is contemplated that the jet propulsion system 408 could be replaced by a propeller disposed rearwardly of the hull 20 and connected to the engine 34 by the driveshaft which, in such an embodiment, extends through the transom 18 of the hull 20. It is also contemplated that the jet propulsion 408 could be replaced by a stern drive unit having an impeller or a propeller. A fuel tank 410 of the watercraft is dispose in the hull 20 forwardly of the engine 34. The watercraft 400 has many other features as would be understood by a person skilled in the art. As these other features are not believed to be necessary to the understanding of the present embodiment, they will not be described herein.

Similarly to the outboard engine 10, the watercraft 400 has a box 412 having at least two opening to receive various lines. The box 412 is connected to the deck 402 remotely from the engine 34. As can be seen, the box 412 is disposed near the engine compartment access opening covered by the cover 306 so as to be easily accessible through this opening. As in the embodiment of FIG. 2, one or more electrical wires or cables 60A, B, C, D, E have one end electrically connected to their corresponding devices and the other end disposed inside the box 412. The end of the one or more electrical wires or cables 60A, B, C, D, E disposed inside the box 412 is/are connected inside the box 412 to an end of one or more corresponding electrical wires or cables 62A, B, C, D, E. The other end of the one or more corresponding electrical wires or cables 62A, B, C, D, E is connected to the ECU 64 which is mounted to the engine 34.

The fuel pump 56G pumps fuel from the fuel tank 410. A fuel hose 60G has one end connected to the fuel pump 56G and the other end disposed inside the box 412. The end of the fuel hose 60G disposed inside the box 412 is connected inside the box 412 to the end of a fuel hose 62G. The other end of the fuel hose 62G is fluidly connected to the fuel injectors 64B of the engine 34. Although not shown, oil from an oil tank is distributed to the engine 34 via oil hoses connected in the box 412 in a manner similar to the fuel hoses 60G and 62G.

It is contemplated that more or less devices than those described above could be connected together by lines connected inside the box 412. It is also contemplated that the watercraft 400 could be provided with more than one box.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. An outboard engine comprising:

a cowling defining an engine compartment;

an internal combustion engine disposed at least in part in the engine compartment;

a driveshaft operatively connected to the internal combustion engine;

one of a propeller and an impeller operatively connected to the driveshaft, the one of the propeller and the impeller rotating about an axis being angled relative to the driveshaft;

a device disposed inside the engine compartment;

a box disposed outside the engine compartment and being operatively connected to the engine compartment, the box defining an opening facing generally downwardly when the driveshaft is generally vertical;

a connector passing through a wall of the engine compartment, the connector having a first portion disposed inside the box and a second portion disposed inside the engine compartment, the first portion of the connector being adapted to connect to an end of a line having a portion adapted to be disposed inside the box, the opening being adapted to receive the line therethrough; and an other line disposed inside the engine compartment, the other line being operatively connected between the device and the second portion of the connector.

2. The outboard engine of claim 1, wherein the box is defined at least in part by the cowling.

3. The outboard engine of claim 2, wherein the box is disposed forwardly of the engine compartment.

4. The outboard engine of claim 3, wherein the cowling has a selectively removable panel defining a front wall of the box;

wherein an interior of the box being accessible by removing the panel.

5. A watercraft comprising:

a hull;

an outboard engine operatively connected to the hull, the outboard engine comprising:

a drive unit;

a bracket connecting the drive unit to the hull, the bracket being pivotable about a first horizontal axis to tilt and trim the drive unit, the drive unit being pivotably connected to the bracket about a second axis generally perpendicular to the first axis, the drive unit being steerable by pivoting the drive unit about the second axis;

the drive unit comprising:

a cowling defining an engine compartment;

an internal combustion engine disposed at least in part in the engine compartment;

a driveshaft operatively connected to the internal combustion engine;

one of a propeller and an impeller operatively connected to the driveshaft, the one of the propeller and the impeller rotating about an axis being angled relative to the driveshaft; and a first device disposed inside the cowling; and a box disposed outside the engine compartment and being operatively connected to the bracket, the drive unit being pivotable about the second axis relative to the box, the box being pivotable about the first axis with the drive unit; and a second device disposed externally of the cowling, the box being adapted to receive a portion of a line adapted to operatively connect the first device and the second device.

6. The watercraft of claim 5, further comprising the line;

wherein the line has a first end operatively connected to the first device;

wherein the line has a second end disposed inside the box, the second end being operatively connected inside the box to a first end of an other line, the other line having a second end disposed outside of the box and being operatively connected to the second device.

7. The watercraft of claim 5, further comprising the line;

wherein the line has a first end operatively connected to the first device;

wherein the line extends from the first end, passes through the box and extends to a second end disposed outside the box, the second end being operatively connected to the second device.

8. The watercraft of claim 7, wherein the box is a first box and the line is a first line;

the watercraft further comprising:

a second box disposed outside the engine compartment and being operatively connected to the engine compartment, the first end of the first line being disposed inside the second box; and a second line having a first end operatively connected to the first device and a second end operatively connected to the first end of the first line inside the second box.

9. The watercraft of claim 5, wherein the outboard engine is a first outboard engine and the line is a first line;

the watercraft further comprising:

a second outboard engine operatively connected to the hull, the second outboard engine comprising:

a drive unit;

a bracket connecting the drive unit to the hull, the bracket being pivotable about a first horizontal axis to tilt and trim the drive unit, the drive unit being pivotably connected to the bracket about a second axis generally perpendicular to the first axis, the drive unit being steerable by pivoting the drive unit about the second axis;

the drive unit comprising:

a cowling defining an engine compartment;

an internal combustion engine disposed at least in part in the engine compartment;

a driveshaft operatively connected to the internal combustion engine;

one of a propeller and an impeller operatively connected to the driveshaft, the one of the propeller and the impeller rotating about an axis being angled relative to the driveshaft; and a third device disposed inside the cowling; and a box disposed outside the engine compartment and being operatively connected to the bracket, the drive unit being pivotable about the second axis relative to the box the box being pivotable about the first axis with the drive unit; and a fourth device disposed externally of the cowling of the second outboard engine; and the box of the first outboard engine and the box of the second outboard engine being adapted to receive a second line adapted to operatively connect the third device and the fourth device and passing to pass through the box of the first outboard engine and the box of the second outboard engine.

10. The watercraft of claim 5, wherein the outboard engine is a first outboard engine;

the watercraft further comprising:

a second outboard engine operatively connected to the hull, the second outboard engine comprising:

a drive unit;

a bracket connecting the drive unit to the hull, the bracket being pivotable about a first horizontal axis to tilt and trim the drive unit, the drive unit being pivotably connected to the bracket about a second axis generally perpendicular to the first axis, the drive unit being steerable by pivoting the drive unit about the second axis;

the drive unit comprising:

a cowling defining an engine compartment;

an internal combustion engine disposed at least in part in the engine compartment;

a driveshaft operatively connected to the internal combustion engine; and one of a propeller and an impeller operatively connected to the driveshaft, the one of the propeller and the impeller rotating about an axis being angled relative to the driveshaft; and a box disposed outside the engine compartment and being operatively connected to the bracket;

wherein the box of the second outboard engine is adapted to receive the line therethrough.

11. An outboard engine comprising:

a drive unit;

a bracket adapted to connect the drive unit to a hull of a watercraft, the bracket being pivotable about a first horizontal axis to tilt and trim the drive unit, the drive unit being pivotably connected to the bracket about a second axis perpendicular to the first axis, the drive unit being steerable by pivoting the drive unit about the second axis;

the drive unit comprising:

a cowling defining an engine compartment;

an internal combustion engine disposed at least in part in the engine compartment;

a driveshaft operatively connected to the internal combustion engine;

one of a propeller and an impeller operatively connected to the driveshaft, the one of the propeller and the impeller rotating about an axis being angled relative to the driveshaft; and a device disposed inside the cowling;

a box disposed outside the engine compartment and being operatively connected to the bracket, the drive unit being pivotable about the second axis relative to the box, the box being pivotable about the first axis with the drive unit; and the box being adapted to receive a portion of a line, the line having an end adapted to be operatively connected to the device.

12. The outboard engine of claim 11, further comprising the line, the end of the line being operatively connected to the device;

wherein the end of the line being operatively connected to the device is a first end;

wherein the line has a second end disposed inside the box, the second end being adapted to connect inside the box to a first end of an other line, the other line having a second end disposed outside of the box and being adapted to operatively connect to an other device disposed externally of the cowling.

13. The outboard engine of claim 11, further comprising the line the end of the line being operatively connected to the device;

wherein the end of the line being operatively connected to the device is a first end;

wherein the line extends from the first end, passes through the box and extends to a second end disposed outside the box, the second end being adapted to operatively connect to an other device disposed externally of the cowling.

14. The outboard engine of claim 13, wherein the line passes through the box via a first opening in a lateral side of the box and a second opening in a top of the box.

15. The outboard engine of claim 11, further comprising the line, the end of the line being operatively connected to the device;

wherein an operative connection between the end of the line and the device is located inside the engine compartment.

16. The outboard engine of claim 11, wherein the second axis is disposed between the box and the driveshaft relative to a longitudinal direction of the outboard engine.

17. The outboard engine of claim 11, wherein the device is one of a fuel injector, an oil supply device, an electrical device, and a data transmission and/or receiving device; and wherein the line is a corresponding one of a fuel hose, an oil hose, an electrical wire, and a data transmission cable.

18. A watercraft comprising:

a hull;

a first outboard engine operatively connected to the hull, the first outboard engine comprising:

a drive unit;

a bracket connecting the drive unit to the hull, the bracket being pivotable about a first horizontal axis to tilt and trim the drive unit, the drive unit being pivotably connected to the bracket about a second axis generally perpendicular to the first axis, the drive unit being steerable by pivoting the drive unit about the second axis;

the drive unit comprising:

a cowling defining an engine compartment;

an internal combustion engine disposed at least in part in the engine compartment;

a driveshaft operatively connected to the internal combustion engine;

one of a propeller and an impeller operatively connected to the driveshaft, the one of the propeller and the impeller rotating about an axis being angled relative to the driveshaft; and a first device disposed inside the cowling; and a box disposed outside the engine compartment and being operatively connected to the bracket;

a second outboard engine operatively connected to the hull, the second outboard engine comprising:

a drive unit;

a bracket connecting the drive unit to the hull, the bracket being pivotable about a first horizontal axis to tilt and trim the drive unit, the drive unit being pivotably connected to the bracket about a second axis generally perpendicular to the first axis, the drive unit being steerable by pivoting the drive unit about the second axis;

the drive unit comprising:

a cowling defining an engine compartment;

an internal combustion engine disposed at least in part in the engine compartment;

a driveshaft operatively connected to the internal combustion engine; and one of a propeller and an impeller operatively connected to the driveshaft, the one of the propeller and the impeller rotating about an axis being angled relative to the driveshaft; and a box disposed outside the engine compartment and being operatively connected to the bracket;

a second device disposed externally of the cowling of the first outboard engine; and a line operatively connecting the first device and the second device, the line having a portion disposed inside the box of the first outboard engine, an end operatively connected to the first device and passes through the box of the second outboard engine.

19. The watercraft of claim 18, wherein the line is a first line;

the watercraft further comprising:

a third device disposed inside the cowling of the second outboard engine;

a fourth device disposed externally of the cowling of the second outboard engine; and a second line operatively connecting the third device and the fourth device and passing through the box of the second outboard engine.

* * * * *

UNITED STATES PATENT AND TRADEMARK OFFICE

CERTIFICATE OF CORRECTION

PATENT NO. : 8,858,280 B1
APPLICATION NO. : 13/285369
DATED : October 14, 2014
INVENTOR(S) : Wiegele et al.

It is certified that error appears in the above-identified patent and that said Letters Patent is hereby corrected as shown below:

In the Claims

Claim 9, Column 22, line 43, “the box the box” should read -- the box, the box --; line 50, “device and passing to pass” should read -- device and to pass --.

Claim 13, Column 23, line 56, “the line the end” should read -- the line, the end --.

Signed and Sealed this
Tenth Day of February, 2015

Michelle K. Lee

Michelle K. Lee
*Deputy Director of the United States Patent and Trademark Office*